US010233799B2

(12) United States Patent
Ogata et al.

(10) Patent No.: US 10,233,799 B2
(45) Date of Patent: Mar. 19, 2019

(54) ENGINE CONTROL DEVICE

(71) Applicant: Hitachi Automotive Systems, Ltd., Hitachinaka-shi, Ibaraki (JP)

(72) Inventors: Kenichiroh Ogata, Tokyo (JP); Takashi Okamoto, Hitachinaka (JP); Yoshinobu Arihara, Hitachinaka (JP); Yoshihiro Sukegawa, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 308 days.

(21) Appl. No.: 15/113,142

(22) PCT Filed: Jan. 7, 2015

(86) PCT No.: PCT/JP2015/050199
§ 371 (c)(1),
(2) Date: Jul. 21, 2016

(87) PCT Pub. No.: WO2015/125505
PCT Pub. Date: Aug. 27, 2015

(65) Prior Publication Data

US 2017/0009621 A1 Jan. 12, 2017

(30) Foreign Application Priority Data

Feb. 20, 2014 (JP) ..... 2014-030167

(51) Int. Cl.
*F01M 5/00* (2006.01)
*F02D 41/00* (2006.01)
(Continued)

(52) U.S. Cl.
CPC ..... *F01M 5/005* (2013.01); *F01M 5/001* (2013.01); *F02D 35/026* (2013.01);
(Continued)

(58) Field of Classification Search
CPC ..... F01M 5/005; F01M 5/001; F02D 35/026; F02D 41/0025; F02D 2041/224;
(Continued)

(56) References Cited

U.S. PATENT DOCUMENTS 6,276,334 B1 * 8/2001 Flynn ..... F02B 19/14 123/435
7,493,883 B2 * 2/2009 Takahashi ..... F01M 1/18 123/196 AB
(Continued)

FOREIGN PATENT DOCUMENTS

DE 10 2010 003 305 A1 9/2011
EP 2 639 433 A1 9/2013
(Continued)

OTHER PUBLICATIONS

International Search Report (PCT/ISA/210) issued in PCT Application No. PCT/JP2015/050199 dated Mar. 10, 2015, with English translation (four (4) pages.
(Continued)

*Primary Examiner* — Freddie Kirkland, III
(74) *Attorney, Agent, or Firm* — Crowell & Moring LLP

(57) ABSTRACT

An engine control device sets a target value for the engine oil temperature appropriately in an engine that uses gasoline as a fuel, even when the fuel does not have a single boiling point because the gasoline is a mixed composition, or when the fuel property changes (for example, when the vaporization property changes due to deterioration). In other words, the engine control device prevents excessive heating or insufficient heating by changing the oil temperature to the high side in a condition wherein the fuel being used does not easily vaporize, and changing the oil temperature to the low side in a condition wherein the fuel being used easily vaporizes. This engine control device includes an oil temperature controller that controls the temperature of oil lubri-
(Continued)

cating the interior of the engine; a fuel supply device that supplies fuel to the engine; and a detector for detecting the property of the fuel. The temperature of the oil is controlled on the basis of a signal from the detector.

8 Claims, 23 Drawing Sheets

(51) Int. Cl.
*H05B 1/02* (2006.01)
*F02D 35/02* (2006.01)
*F02D 41/22* (2006.01)

(52) U.S. Cl.
CPC ..... *F02D 41/0025* (2013.01); *H05B 1/0236* (2013.01); *F02D 41/003* (2013.01); *F02D 41/22* (2013.01); *F02D 2041/224* (2013.01); *F02D 2200/023* (2013.01); *F02D 2200/0611* (2013.01); *F02D 2250/08* (2013.01); *F02D 2250/11* (2013.01)

(58) Field of Classification Search
CPC ..... F02D 41/22; F02D 2200/0611; F02D 2250/11; F02D 41/003; F02D 2200/023; F02D 2250/08; H05B 1/0236
See application file for complete search history.

(56) References Cited

U.S. PATENT DOCUMENTS 9,157,389 B2 * 10/2015 Nonoyama ..... F02D 41/0025
9,194,313 B2 * 11/2015 Shishime ..... F02D 35/021
9,404,402 B2 * 8/2016 Pursifull ..... F01M 5/001
9,470,173 B2 * 10/2016 Lehmen ..... F02D 41/064
9,512,751 B2 * 12/2016 Jo ..... F01M 1/18
9,726,067 B2 * 8/2017 Hakeem ..... F01P 7/10
2007/0131193 A1 6/2007 Takahashi
2012/0042845 A1 * 2/2012 Kanai ..... F01M 1/10 123/196 AB
2012/0253639 A1 * 10/2012 Nonoyama ..... F02D 41/0025 701/103
2012/0271533 A1 10/2012 Shishime
2013/0125853 A1 5/2013 Pursifull
2016/0194999 A1 * 7/2016 Hakeem ..... F01P 7/10 123/41.05

FOREIGN PATENT DOCUMENTS

JP 57-181913 A 11/1982
JP 2004-293394 A 10/2004
JP 2004293394 A * 10/2004 ..... F01M 1/08
JP 2007-162569 A 6/2007
JP 2009-144540 A 7/2009
JP 2009144540 A * 7/2009 ..... F01M 1/08
JP 2009-299669 A 12/2009
JP 4962625 B2 6/2012
JP 2012-246795 A 12/2012
WO WO 99/42718 A1 8/1999
WO WO 2012/137055 A1 10/2012

OTHER PUBLICATIONS

Japanese-language Written Opinion (PCT/ISA/237) issued in PCT Application No. PCT/JP2015/050199 dated Mar. 10, 2015 (seven (7) pages.
Extended European Search Report issued in counterpart European Application No. 15752479.4 dated Aug. 28, 2017 (7 pages).
Cover page of EP 0 983 433 A1 published Mar. 8, 2000 (1 page).

* cited by examiner

ENGINE CONTROL DEVICE

TECHNICAL FIELD

The present invention relates to an engine control device mounted in such as a vehicle.

BACKGROUND ART

Current vehicles are strongly required to reduce fuel consumption from the viewpoint of environmental protection. As a unit that reduces the fuel consumption, a downsized engine including a cylinder direct injection fuel supply device is being developed. The cylinder direct injection fuel supply device directly injects fuel in a combustion chamber by using a fuel injection valve (hereinafter called an injector) and can suppress abnormal combustion by cooling in the combustion camber. By suppressing the abnormal combustion, an engine can be downsized, and fuel consumption can be reduced. In the above-described downsized engine, a combustion chamber capacity is reduced, and a distance between the above-described injector and a wall surface is shortened. Therefore, injected fuel is easily attached on a piston crown surface and a wall surface of such as a cylinder. The attached fuel is introduced in a crank case by being scraped off by a piston ring and dissolved in engine oil. As a result, the engine oil is diluted by the fuel (hereinafter called oil dilution), and lubrication performance is deteriorated.

Therefore, for example, PTL 1 discloses a heating device for a lubricant in an internal combustion engine. In the heating device, an oil pump is provided which defines a lubricant heating chamber in a crank case of the internal combustion engine and force-feeds, in the heating chamber, the lubricant in a lubricant reservoir provided at a lower portion of the crank case, an outlet which causes the lubricant stored in the chamber to overflow and circulate in the lubricant reservoir is opened on a partition wall of the lubricant heating chamber, a breather port communicated with a gap provided at an upper portion in the chamber is opened in the lubricant heating chamber, the breather port is communicated with a breather chamber formed at an upper portion of the crank case, and the heater which operates when an oil temperature in the lubricant reservoir is at a predetermined temperature or lower and heats the lubricant stored in the chamber is provided in the lubricant heating chamber.

In addition, for example, PTL 2 discloses an engine oil dilution prevention device. The engine oil dilution prevention device includes a detection unit, a heating device, and a control unit. The detection unit detects a parameter on a dilution ratio of engine oil. The heating device heats the engine oil. The control unit causes the heating device to operate based on a result of a comparison between the parameter detected by the detection unit and a predetermined threshold.

In addition, for example, PTL 3 discloses a diluted oil regeneration device. The diluted oil regeneration device includes an injector, a regeneration timing detection unit, an oil heating unit. The injector supplies fuel to an engine. The regeneration timing detection unit detects a timing to regenerate engine oil diluted by the fuel injected from the injector. The oil heating unit heats and regenerates the engine oil diluted by the fuel at the timing to regenerate engine oil, and the oil heating unit heats engine cooling water.

In addition, for example, PTL 4 discloses an oil dilution suppression device. The oil dilution suppression device is mounted in a vehicle including an engine in which alcohol fuel can be used. The oil dilution suppression device includes an intake air amount integrating unit, a temperature detection unit, and a control unit. The intake air amount integrating unit calculates an integrated intake air amount by integrating the amount of air taken in the engine while the engine is operated. The temperature detection unit detects a temperature of engine oil of the engine. The control unit controls the vehicle so as to shift to an oil heating mode in which the oil temperature is increased in the case where the calculated integrated intake air amount is larger than an integrated intake air amount threshold and in the case where the detected oil temperature is lower than a first temperature threshold. PTL 4 discloses that a target heating temperature in the oil heating mode is set in consideration of a boiling point of alcohol fuel.

CITATION LIST

Patent Literature

PTL 1: JP 57-181913 A
PTL 2: JP 2004-293394 A
PTL 3: JP 2007-162569 A
PTL 4: JP 4962625 B2

SUMMARY OF INVENTION

Technical Problem

In the technique described in PTL 1, lubricant is heated in a low oil temperature state in which oil is easily diluted, and therefore oil which is not diluted is also heated, and oil is excessively heated.

In addition, in the technique described in PTL 2, it is considered that excessive heating can be suppressed in the case where oil is not diluted since heating of engine oil is controlled when oil dilution reaches a predetermined amount or more. However, an index for setting a heat control temperature is not set, and therefore lubrication performance regeneration becomes insufficient by excessive heating and insufficient heating in the case where oil is diluted.

In addition, in the technique described in PTL 3, it is considered that oil is heated by using heating of cooling water, and the oil is heated without using a device which directly heats the oil. However, an index for setting a heat control temperature is not set, and therefore lubrication performance regeneration becomes insufficient by excessive heating and insufficient heating in the case where oil is diluted.

It is disclosed that, in these conventional techniques, a unit that regenerates lubrication performance of diluted oil vaporizes fuel by heating oil. However, a target engine oil temperature is not accurately indicated, and therefore fuel consumption is deteriorated by excessive heating, or lubrication performance regeneration becomes insufficient by insufficient heating.

Here, it is considered that, in the technique described in PTL 4, a boiling point of alcohol fuel is set to a target engine oil temperature. Therefore, in the case of alcohol fuel, oil can be appropriately heated, and both of fuel consumption and lubrication performance regeneration can be achieved. However, in the case of gasoline, mixed fuel, and gas-liquid mixture fuel, it is hard to set a boiling point since those are mixture. Therefore fuel consumption is deteriorated due to excessive heating, or lubrication performance regeneration becomes insufficient due to insufficient heating.

As described above, in conventional techniques, an engine in which fuel, such as gasoline, mixed fuel, and gas-liquid mixture fuel is used does not have a single boiling point since such fuel has mixed composition, and also fuel properties are changed. For example, in the case where vaporization characteristics are changed by deterioration, excessive heating or insufficient heating is inevitable if a boiling point is set to a target engine oil temperature. As a result, fuel consumption is deteriorated, and lubrication performance regeneration becomes insufficient.

The present invention is in view of the above description. An object of the present invention is to provide an engine control device in which both of fuel consumption and lubrication performance regeneration are achieved by setting an oil temperature in an oil heating unit based on fuel properties.

Solution to Problem

To achieve the object, the engine control device according to the present invention controls a temperature of the oil lubricating the interior of an engine, and the device controls the oil temperature based on a detection result of the properties of fuel being supplied to the engine.

Advantageous Effects of Invention

According to the present invention, a target engine oil temperature can be appropriately set in an engine in which fuel such as gasoline, mixed fuel, and gas-liquid mixture fuel is used, although the fuel does not have a single boiling point since such fuel has mixed composition, and even if the fuel property is changed, for example, the vaporization characteristics are changed due to deterioration. In other words, the engine control device can prevent excessive heating or insufficient heating by changing the oil temperature to a high temperature side in the case where the fuel being used does not easily vaporize, and changing the oil temperature to a low temperature side in the case where the fuel being used easily vaporizes. As a result, the suppression contributes to fuel consumption and lubrication performance regeneration.

DESCRIPTION OF EMBODIMENTS

A configuration and an operation of the engine control device according to the present invention will be described below with reference to FIGS. 1 to 23.

FIGS. 1 to 23 describe a configuration of a system in which a control device is used in a vehicle engine. The control device controls a temperature of oil lubricating the interior of the engine and controls the oil temperature based on a detection result of the property of fuel being supplied to the engine.

Figure 1:
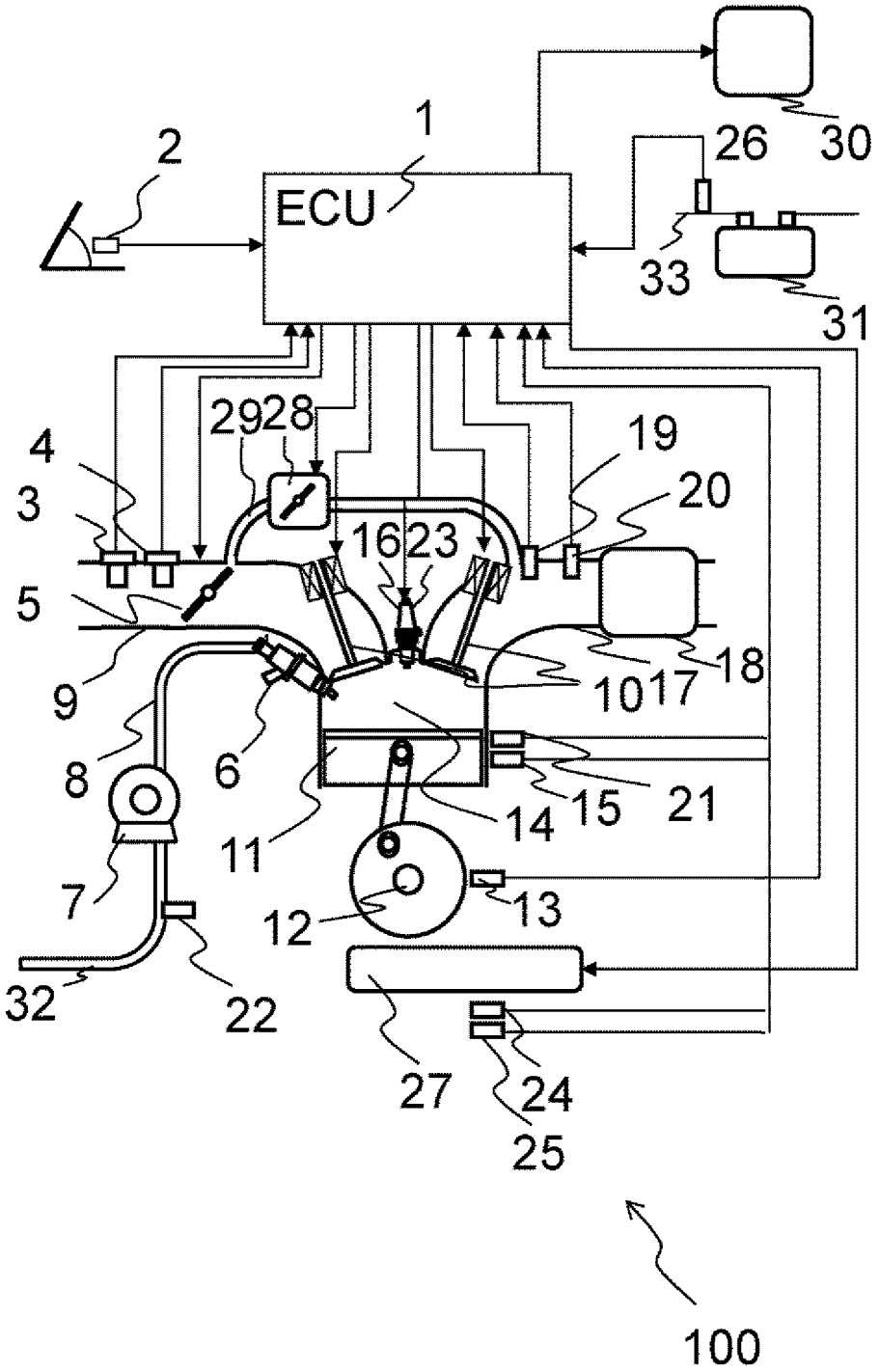
FIG. 1 is a system configuration view of a vehicle engine system according to an embodiment described herein.

FIG. 1 is a system configuration view of a vehicle engine system according to an embodiment described herein. An engine 100 is a vehicle engine which performs a spark-ignition combustion. Each of an air flow sensor 3, a throttle 5, and an intake air temperature/humidity sensor 4 is provided at an appropriate position of an intake pipe 9. The air flow sensor 3 measures an intake air amount. The throttle 5 adjusts an intake pipe pressure. The intake air temperature/humidity sensor 4 is one mode of an intake air temperature/humidity detector and measures a temperature and a humidity of intake air.

The air flow sensor 3 may be an intake air pressure sensor. In addition, the engine 100 includes a fuel injector (hereinafter called an injector) 6 and an ignition plug 16. The injector 6 injects fuel in a combustion chamber 14. The ignition plug 16 supplies ignition energy. A variable valve 10 is provided at an appropriate position of the engine 100. The variable valve 10 adjusts intake air flowing in the combustion chamber 14 and exhaust air flowing out from the combustion chamber 14. Each of a common rail 8, a fuel pump 7, and a fuel piping 32 is provided at an appropriate position of the engine 100. The common rail 8 supplies fuel by connecting with the injector 6. The fuel pump 7 force-feeds fuel to the common rail 8. The fuel piping 32 supplies the fuel to the fuel pump 7.

In addition, a fuel pressure sensor is provided at an appropriate position of the common rail 8. The fuel pressure sensor is one mode of a fuel pressure detector and measures a fuel pressure. Here, the fuel pressure sensor may be a fuel temperature sensor.

In addition, a fuel property sensor 22 is provided at an appropriate position of the common rail 8. The fuel property sensor 22 is one mode of a fuel property detector and measures fuel properties. In addition, the fuel property sensor 22 may be provided to any of the injector 6, the fuel pump 7, and the fuel piping 32.

Further, each of a three-way catalyst 18, an exhaust temperature sensor 19, an air fuel ratio sensor 20, and an exhaust recirculation pipe 29 are provided at an appropriate position of an exhaust pipe 17. The three-way catalyst 18 purifies exhaust air. The exhaust temperature sensor 19 is one mode of an exhaust air temperature detector and measures an exhaust air temperature on an upper stream side of the three-way catalyst 18. The air fuel ratio sensor 20 is one mode of an air fuel ratio detector and detects an air fuel ratio of exhaust air on an upper stream side of the three-way catalyst 18. The exhaust recirculation pipe 29 is connected to the intake pipe 9. The air fuel ratio sensor 20 may be an oxygen concentration sensor.

In addition, an EGR valve 28 which adjusts an exhaust recirculation amount is provided at an appropriate position of the exhaust recirculation pipe 29. Further, a crank shaft 12 includes a crank angle sensor 13. The crank angle sensor 13 detects an angle and a rotation speed of the crank shaft 12 and a moving speed of a piston 11. Furthermore, a cooling water temperature sensor 15 is provided at an appropriate position of the engine 100.

In addition, an oil temperature sensor 25 is provided at an appropriate position of the engine 100. The oil temperature sensor 25 detects a temperature of oil lubricating the interior of the engine is provided at an appropriate position of the engine 100. Further, an oil pressure sensor 24 is provided at an appropriate position of the engine 100. The oil pressure sensor 24 detects the pressure of the oil lubricating the interior of the engine. Furthermore, an accelerator sensor 21 is provided at an appropriate position of the engine 100. The accelerator sensor 21 detects an acceleration of the engine.

In addition, an ion sensor 23 is provided at an appropriate position of the engine 100. The ion sensor 23 detects an amount of ions generated by combustion of fuel in the engine. Further, the ion sensor 23 may be a pressure sensor which detects a pressure in an engine.

In addition, a storage battery 31 is provided to a vehicle engine system with the engine 100. The storage battery 31 supplies power to the vehicle engine system via a wire 33. Further, a voltage sensor 26 is provided at an appropriate position of the wire 33. The voltage sensor 26 is one mode of a voltage detector and measures a voltage of the storage battery 31. Here, the voltage sensor 26 may be a current sensor.

In addition, the heater 27 for heating oil lubricating the engine 100 is provided to the engine 100. Further, a warning lamp 30 is provided at an appropriate position of the vehicle engine system.

Signals obtained from the air flow sensor 3, the intake air temperature sensor 4, the fuel pressure sensor provided on the common rail 8, the crank angle sensor 13, the cooling water temperature sensor 15, the exhaust temperature sensor 19, the air fuel ratio sensor 20, the accelerator sensor 21, the fuel property sensor 22, the ion sensor 23, the oil pressure sensor 24, the oil temperature sensor 25, and the voltage sensor 26 are sent to an engine control unit (hereinafter called an ECU 1). A signal obtained from an accelerator opening sensor 2 is sent to the ECU 1. The accelerator opening sensor 2 detects a stepping amount of an accelerator pedal, in other words, an accelerator opening. The ECU 1 calculates a request torque based on a signal output from the accelerator opening sensor 2. In other words, the accelerator opening sensor 2 is used as a request torque detection sensor which detects a request torque with respect to the engine 100. The ECU 1 calculates an angle and a rotation speed of the crank shaft 12 and a moving speed of the piston 11 based on an output signal of the crank angle sensor 13.

Based on an operation state of the engine 100, which is obtained from an output from each of the above-described sensors, the ECU 1 appropriately calculates an opening of the throttle 5, a valve opening/closing timing of the variable valve 10, an opening of the EGR valve 28, a fuel force-feeding pressure of the fuel pump 7, an injection pulse period of the injector 6, an ignition timing of the ignition plug 16, major operation amounts of the engine 100 including the heater 27 and the warning lamp 30. The injection guise period calculated by the ECU 1 is converted into an injector valve opening pulse signal and sent to the injector 6. An ignition plug drive signal is sent to the ignition plug 16 so as to ignite at the ignition timing calculated by the ECU 1. The throttle opening calculated by the ECU 1 is sent to the throttle 5 as a throttle drive signal. The EGR valve opening calculated by the ECU 1 is sent to the EGR valve 28 as an EGR valve drive signal. The valve opening/closing timing calculated by ECU 1 is sent to the variable valve 10 as a variable valve drive signal. Fuel is ignited to air flowing from the intake pipe 9 to the combustion chamber 14 via an intake valve, and air-fuel mixture is formed. The air-fuel mixture is exploded by sparks generated from the ignition plug 16 at a predetermined ignition timing, and the piston 11 is pushed down by a combustion pressure by the explosion and becomes a driving force of the engine 100. Exhaust after the explosion is sent to the three-way catalyst 18 via the exhaust pipe 17, and exhaust components are exhausted after being purified in the three-way catalyst 18. The engine 100 is mounted in a vehicle, and information on a traveling state of the vehicle is sent to the ECU 1.

Figure 2:
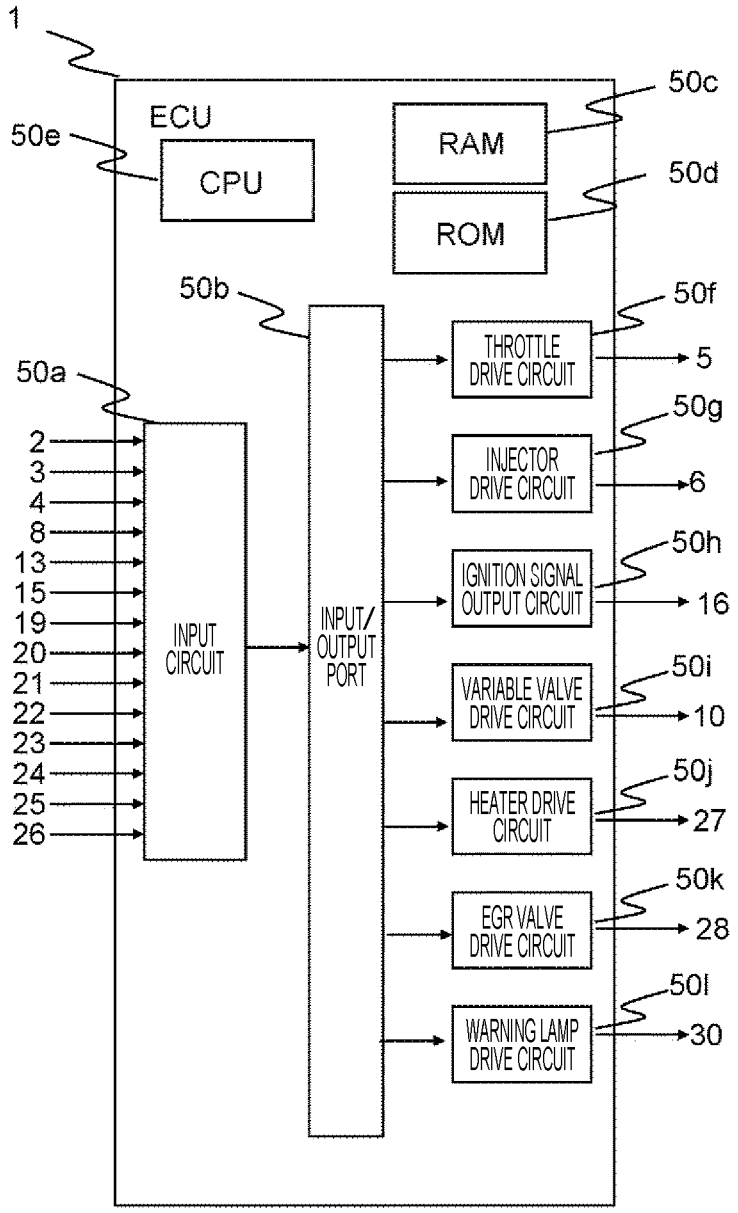
FIG. 2 is a system block diagram illustrating a configuration of an ECU 1 according to an embodiment of the present invention.

FIG. 2 is a system block diagram illustrating a configuration of the ECU 1 according to the embodiment of the present invention. Output signals of the accelerator opening sensor 2, the air flow sensor 3, the intake air temperature sensor 4, the fuel pressure sensor provided on the common rail 8, the crank angle sensor 13, the cooling water temperature sensor 15, the exhaust temperature sensor 19, the air fuel ratio sensor 20, the accelerator sensor 21, the fuel property sensor 22, the ion sensor 23, the oil pressure sensor 24, the oil temperature sensor 25, and the voltage sensor 26 are sent to an input circuit 50*a* of the ECU 1. However, an input signal is not limited to the above.

An input signal of each of the input sensors is sent to an input/output port in the input/output port 50*b*. A value sent to the input/output port 50*b* is stored in RAM 50*c* and calculated by a CPU 50*e*. A control program in which operation process contents are written is preliminary written in ROM 50*d*. A value indicating an operating amount of each actuator, which is calculated in accordance with the control program, is stored in the RAM 50*c*, sent to an output port of the input/output port 50*b*, and sent to each actuator via each drive circuit.

Examples of the drive circuit according to the embodiment include a throttle drive circuit 50*f*, an injector drive circuit 50*g*, an ignition output circuit 50*h*, a variable valve drive circuit 50*i*, a heater drive circuit 50*j*, an EGR valve drive circuit 50*k*, and a warning lamp drive circuit 50*l*. Each circuit controls the throttle 5, the injector 6, the ignition plug 16, the variable valve 10, the heater 27, the EGR valve 28, and the warning lamp 30. According to the embodiment, the drive circuit is included in the ECU 1, but it is not limited thereto, and any of the above-described drive circuits may be included in the ECU 1.

Figure 3:
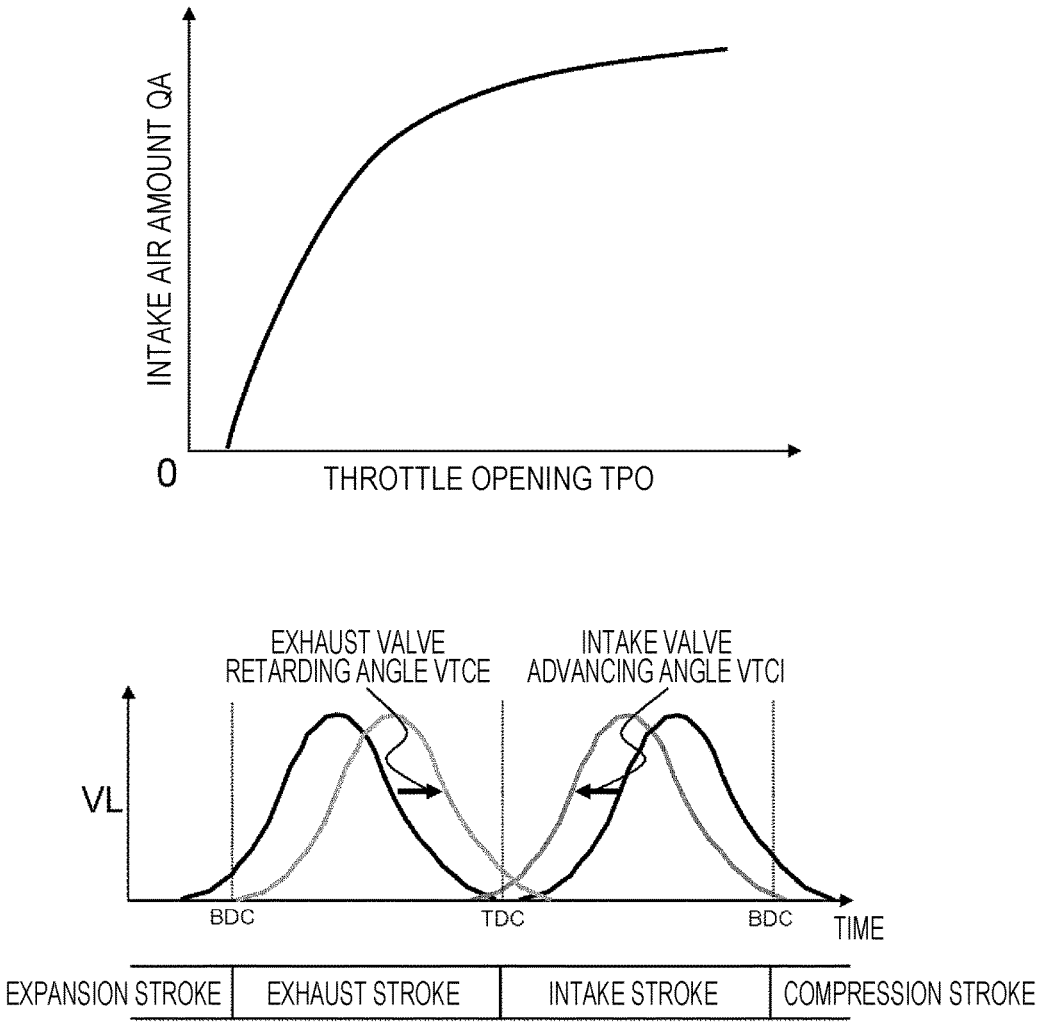
FIG. 3 illustrates characteristics of a throttle and a variable valve according to the embodiment of the present invent ion.

FIG. 3 illustrates characteristics of the throttle 5 and characteristics of the variable valve according to the embodiment of the present invention. A vertical axis of the upper diagram indicates an intake air amount QA, a horizontal axis indicates a throttle opening TPO, and the diagram indicates characteristics of the intake air amount QA corresponding to the throttle opening TPO. With an increase in the throttle opening TPO, the intake air amount QA can increase.

A vertical axis of the lower diagram indicates a valve lift amount VL, and a horizontal axis indicates an elapsed time. A lower portion of the drawing indicates strokes (expansion, exhaust, intake, and compression) of the engine 100 corresponding to the elapsed time. An exhaust valve can he opened and closed from exhaust and expansion strokes to an intake stroke, and an intake valve can be opened and closed from an exhaust stroke to a compression stroke. A timing in which an exhaust valve lift amount VL starts increasing is defined to an exhaust valve opening timing. A timing in which the amount is decreased to zero after the increase is defined to an exhaust valve closing timing. A variable mechanism is provided such that each of the exhaust valve opening timing and the exhaust valve closing timing is delayed on a time base, and the variable amount is defined to an exhaust valve retarding angle VTCE. A timing in which the intake valve lift amount VL starts increasing is defined to an intake valve opening timing. A timing in which the amount is decreased to zero after the increase is defined to an intake valve closing timing. A variable mechanism is provided such that each of the intake valve opening timing and the intake valve closing timing is advanced on a time base, and the variable amount is defined to an intake valve advancing angle VTCI.

In the embodiment, the intake valve and the exhaust valve include a variable mechanism which continuously and gradually changes a profile of the valve lift amount VL, but it is not limited to the above, and the mechanism may be included only in the intake valve. Further, a mechanism which varies the valve lift amount VL may be included. The intake air amount QA in the combustion chamber 14 is adjusted by controlling the variable valve 10 and the throttle 5.

Figure 4:
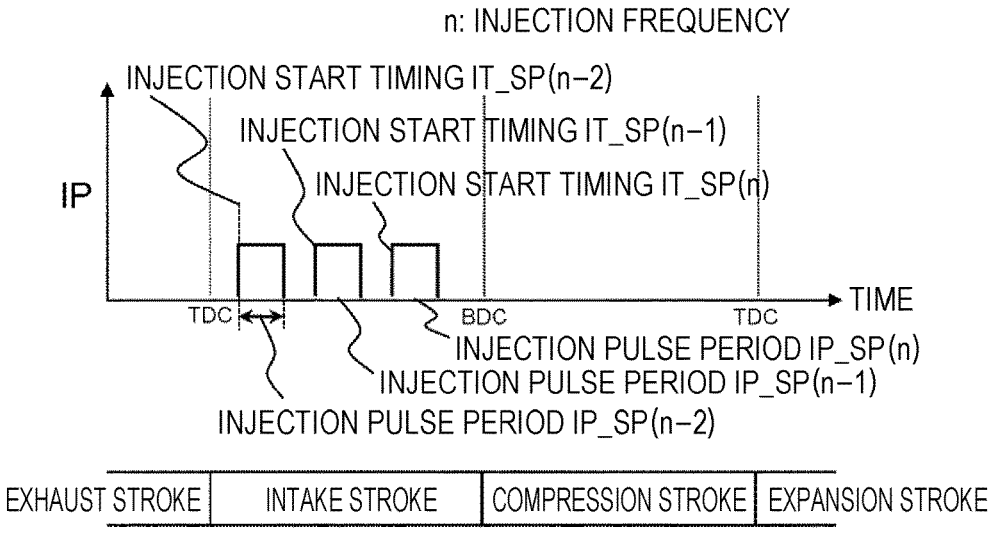
FIG. 4 describes characteristics of an injector 6 and characteristics of an injection command value in a command signal output from an input/output port 50*b* to the injector 6 according to the embodiment of the present invention.
Figure 4:
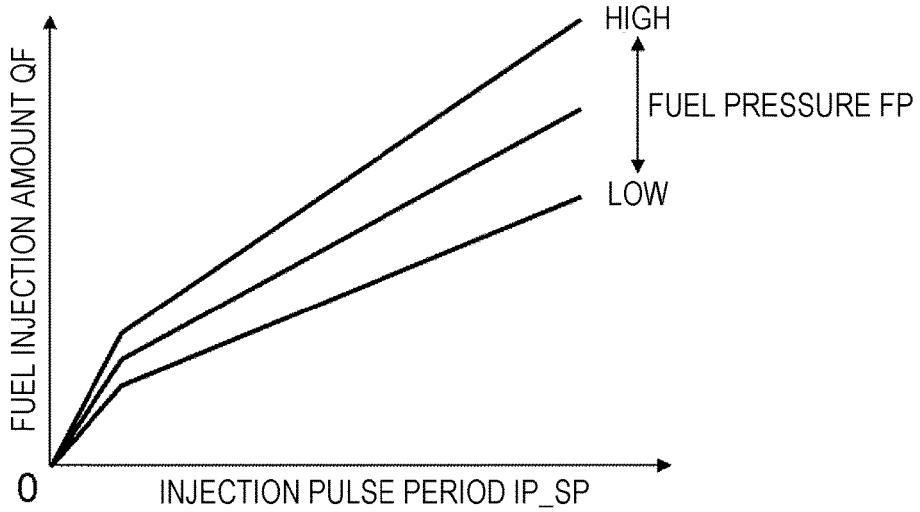

FIG. 4 illustrates characteristics of the injector 6 and characteristics of an injection command value in a command signal output from an input/output port 50*b* to the injector 6, according to the embodiment of the present invention. A vertical axis of the upper diagram indicates a voltage IP of an injection pulse, and a horizontal axis indicates an elapsed time. BDC indicates that the piston 11 is positioned at a bottom dead point. TDC indicates that the piston 11 is positioned at a top dead point. A lower portion of the diagram indicates strokes (exhaust, intake, compression, expansion) of the engine 100 corresponding to the elapsed time.

The engine control device according to the present invention can output injection commands multiple times. The diagram illustrates three injection pulses in the intake stroke as a representative example. Here, an initial rising timing of the above multiple time injection pulses in the intake stroke is defined as an injection start timing IT_SP (n-2). A period from the rising timing to a subsequent falling timing is defined as an initial stage injection pulse period IP_SP (n-2). A last stage rising timing of the multiple time injection pulses is defined as an injection start timing IT_SP(n). A period from the rising timing to the falling timing is defined as a last stage injection pulse period IP_SP (n). Here, n indicates an injection frequency. In addition, similarly, the engine control device can output injection commands multiple times in a compression stroke, an expansion stroke, and an exhaust stroke. A vertical axis in the lower diagram indicates a fuel injection amount QF, and a horizontal axis indicates the injection pulse period IP_SP. With an increase in the injection pulse period IP_SP, the fuel injection amount QF can increase. Further, the characteristics are changed as illustrated in the diagram in response to a fuel pressure FP of the common rail 8.

Figure 5:
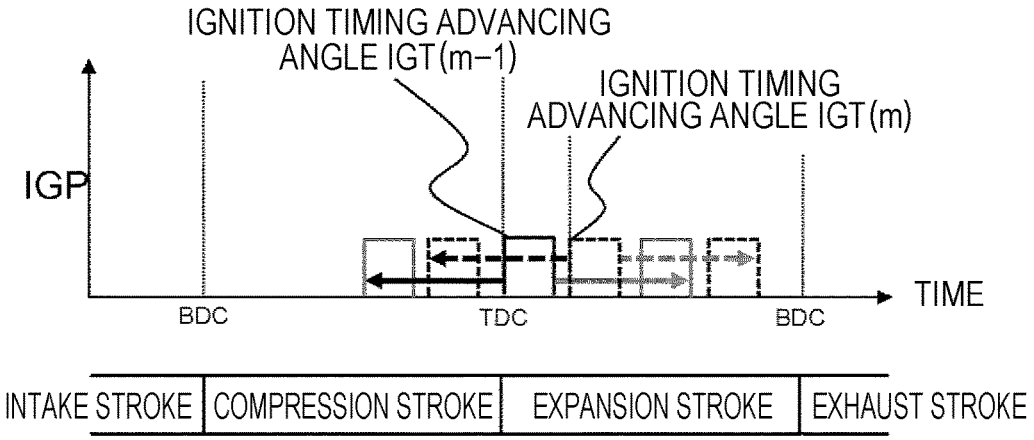
FIG. 5 describes characteristics of an ignition command value in a command signal output from an input/output port 50*b* to an ignition plug 16 and EGR flow characteristics with respect to an EGR command value in a command signal output from the input/output port 50*b* to an EGR valve 28, according to the embodiment of the present invention.
Figure 5:
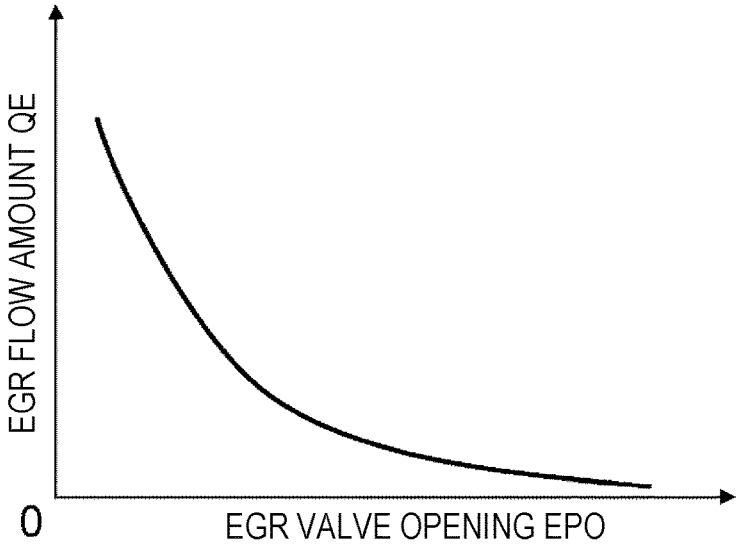

FIG. 5 indicates characteristics of an ignition command value in a command signal output from the input/output port 50*b* to the ignition plug 16 and EGR flow characteristics with respect to an EGR command value in a command signal output from the input/output port 50*b* to the EGR valve 28, according to the embodiment of the present invention. A vertical axis of the upper diagram indicates a voltage IGP of an ignition pulse, and a horizontal axis indicates an elapsed time. BDC indicates that the piston 11 is positioned at a bottom dead point. TDC indicates that the piston 11 is positioned at a top dead point. A lower portion of the diagram indicates strokes (intake, compression, expansion, and exhaust) of the engine 100 corresponding to the elapsed time.

The engine control device according to the present invention can output ignition commands multiple times. The diagram illustrates twice ignition pulses as a representative example. Here, an initial rising timing in the compression stroke of the multiple time ignition pulses is defined as an ignition start timing IGT (m-1), and a timing of a last stage rising timing of the multiple time ignition pulses is defined as an ignition start timing IGT (m). Herein, m indicates an ignition frequency. In addition, similarly, injection commands can be output multiple times in an intake stroke, an expansion stroke, and an exhaust stroke. A vertical axis of the lower diagram indicates an EGR flow amount QE, and a horizontal axis indicates an EGR valve opening EPO or the EGR valve 28. With an increase in the EGR valve opening EPO, the EGR flow amount QE can increase.

Figure 6:
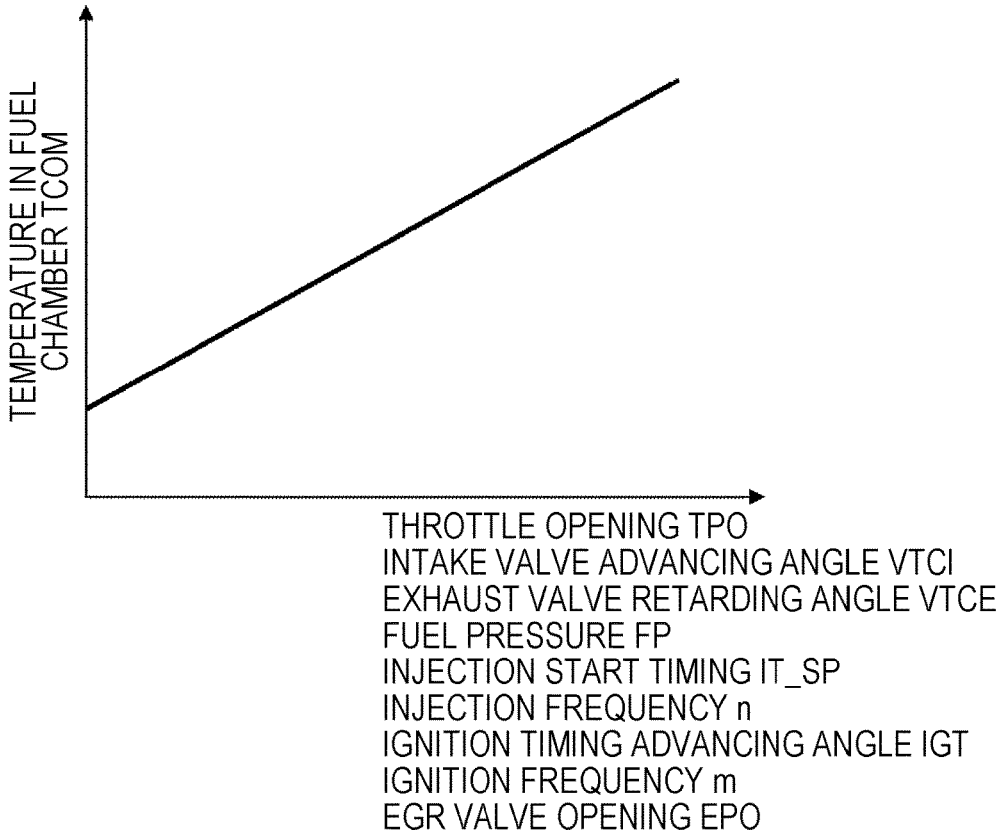
FIG. 6 describes characteristics of a temperature in a combustion chamber with respect to the above-described command value and characteristics of an oil temperature with respect to the temperature in the combustion chamber, according to the embodiment of the present invention.
Figure 6:
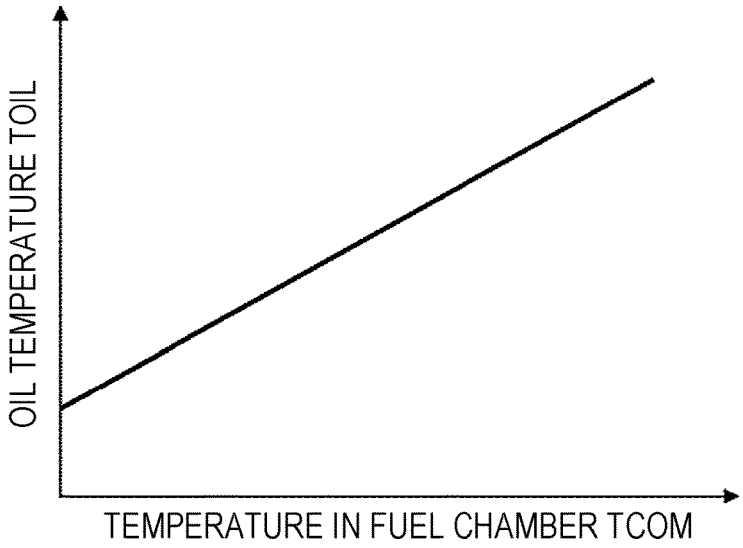

FIG. 6 indicates characteristics of a temperature in a combustion chamber with respect to the above-described command values and characteristics of an oil temperature with respect to the temperature in the combustion chamber, according to the embodiment of the present invention. A vertical axis of the upper diagram indicates The temperature in a combustion chamber TCOM, and a horizontal axis indicates each of the above-described command values. The temperature in a combustion chamber TCOM increases with an increase in each of the command values, such as the throttle opening TPO, the intake valve advancing angle VTCI, the exhaust valve retarding angle VTCE, the injection start timing IT_SP, the fuel pressure FP, the injection frequency n, the ignition timing advancing angle IGT, the ignition frequency m, and the EGR valve opening EPO. The temperature in a combustion chamber TCOM is changed by each command by the following factors.

As the throttle opening TPO increases, the intake air amount QA increases, and fuel energy increases. In addition, as the intake valve advancing angle VTCI increases, the intake valve close timing approaches to the BDC as illustrated in the characteristic drawing of the variable valve, and an actual compression ratio increases. In addition, as the exhaust valve retarding angle VTCE increases, the exhaust valve opening timing approaches to the BDC as illustrated in the characteristic diagram of the variable valve, and an actual compression ratio increases. In addition, the injection start timing IT_SP increases based on the BDC. In other words, when the timing approaches to the TDC in an intake stroke, a time to the TDC in the compression stroke is increased. As a result, fuel further vaporizes and mixes with intake air. Further, when the fuel pressure FP increases, fuel injected from the injector 6 is atomized and mixed with the intake air, and noncombustible components are reduced. In addition, when the injection frequency n increases, a penetrating force of the fuel injected from the injector 6 reduces, and an extending distance is shortened. As a result, fuel attached on a wall surface of the combustion chamber is decreased. In addition, as the ignition timing advancing angle IGT increases, a timing to ignite to air-fuel mixture in the combustion chamber 14 is advanced, and a pressure in the combustion chamber 14 increases. In addition, an increase in the ignition frequency m is equal to increasing ignition energy sharing with the air-fuel mixture in the combustion chamber 14. As a result, a capacity of a fire nuclear at an initial combustion stage generated by the ignition is increased, and a combustion speed increases. When the EGR valve opening EPO increases, the EGR flow amount QE decreases as illustrated in the characteristic diagram of the EGR valve 28. As a result, the EGR flow flowing in the combustion chamber 14 decreases, and specific heat of air-fuel, mixture decreases.

A vertical axis of the lower diagram indicates the oil temperature TOIL, and a horizontal axis indicates the temperature in a combustion chamber TCOM. As the temperature in a combustion chamber TCOM increases, the oil temperature TOIL increases. This is because a temperature of the engine 100 is increased when the temperature in a combustion chamber increases, and oil lubricating the engine 100 is also heated.

Figure 7:
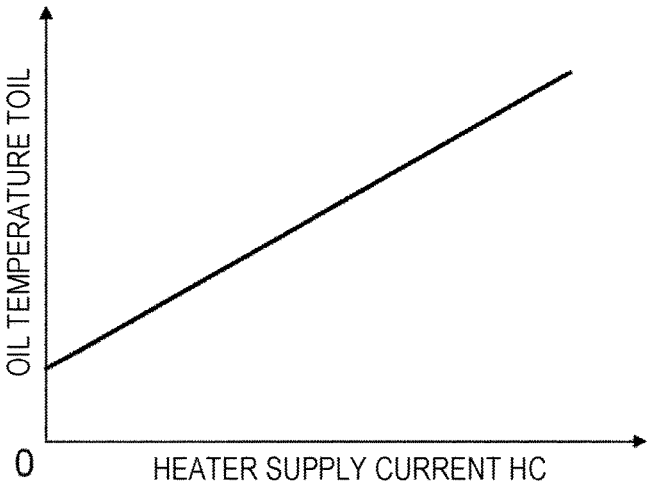
FIG. 7 describes characteristics of an oil temperature TOIL with respect to a heater supply current HC supplied to a heater 27 and characteristics of the oil temperature TOIL with respect to an engine startup time TO, according to the embodiment of the present invention.
Figure 7:
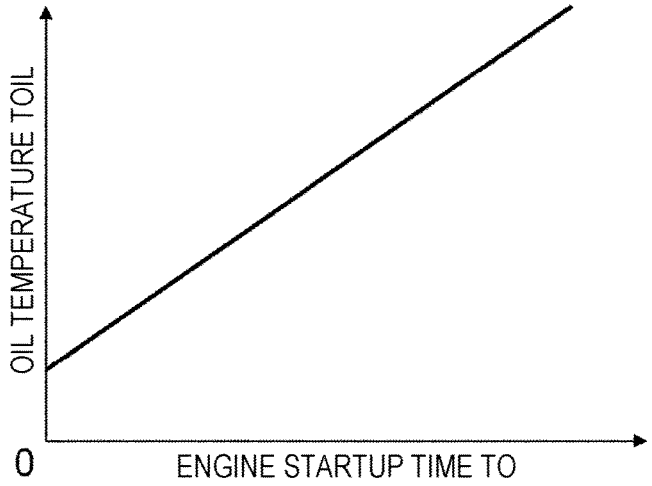

FIG. 7 illustrates characteristics of the oil temperature TOIL with respect to the heater supply current HC supplied to the heater 27 and characteristics of the oil temperature TOIL with respect to an engine startup time TO, according to the embodiment of the present invention. A vertical axis of the upper diagram indicates the oil temperature TOIL, and a horizontal axis indicates the heater supply current HC. As the heater supply current HC increases, the oil temperature TOIL increases. A vertical axis of the lower diagram indicates an oil temperature TOIL, and a horizontal axis indicates an engine startup time TO. When the engine startup time TO increases, the oil temperature TOIL increases. This is because the engine 100 is heated as an operation time of the engine 100 is getting long.

Figure 8:
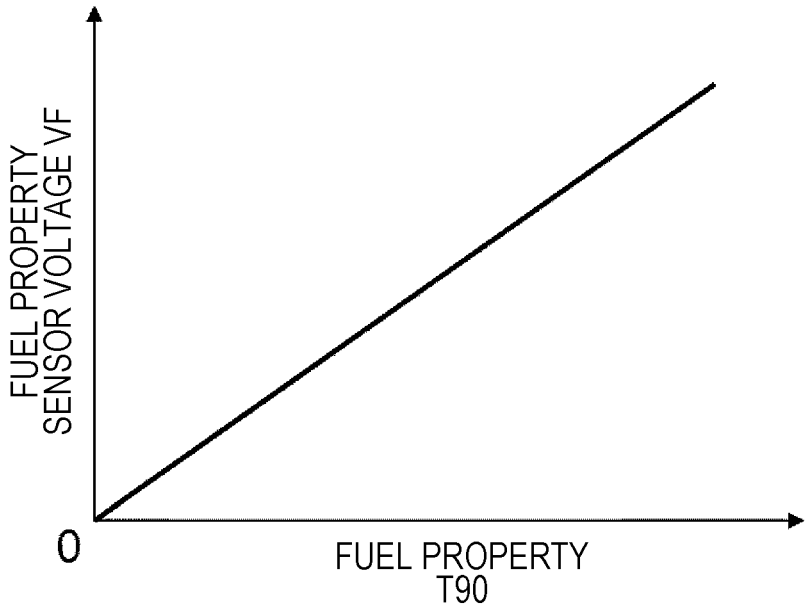
FIG. 8 describes characteristics of a fuel property sensor and characteristics of an octane number and a deterioration level with respect to the fuel property T90, according to the embodiment of the present invention.
Figure 8:
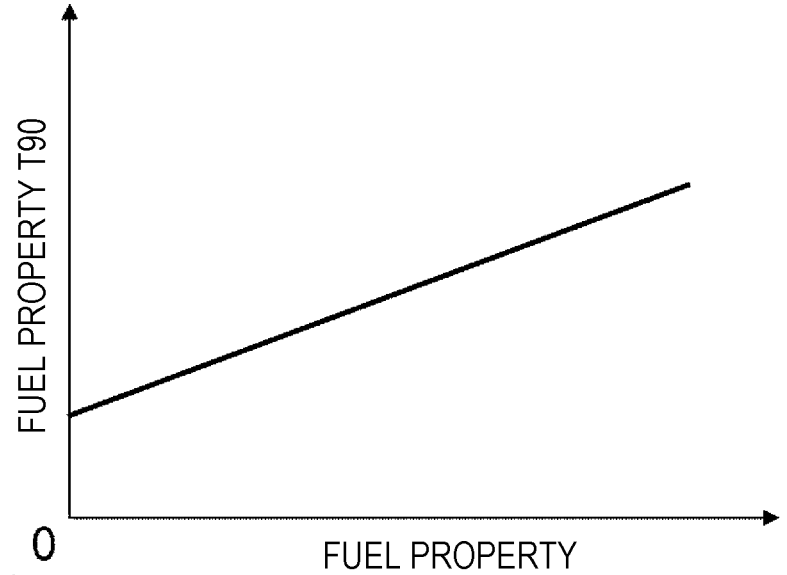

FIG. 8 illustrates characteristics of the fuel property sensor 22 and characteristics of an octane number and a deterioration level with respect to the fuel property T90, according to the embodiment of the present invention. T90 means 90% of a fuel distillation temperature. A vertical axis of the upper diagram indicates a fuel property sensor voltage VF, and a horizontal axis indicates the fuel property T90. When the fuel property T90 increases, the fuel property sensor voltage VF increases. A vertical axis of the lower diagram indicates the fuel property T90, and a horizontal axis indicates the fuel property 1/octane number NO and a fuel property deterioration level LDE. When the fuel property 1/octane number NO or fuel property deterioration level LDE increases, the fuel property T90 increases. This is because the fuel property 1/octane number NO increases, in other words, heavy components of fuel increase, and a self-ignition temperature decreases. In addition, the fuel property deterioration level LDE increases, in other words, light components of the fuel decreases, and the fuel nature is changed and deteriorated. Further, according to the present invention, the fuel property T90, 1/ octane number NO, the deterioration level LDE are calculated, but it is not limited thereto, and vaporization characteristics and combustion characteristics regarding compositions of the fuel may be used.

Figure 9:
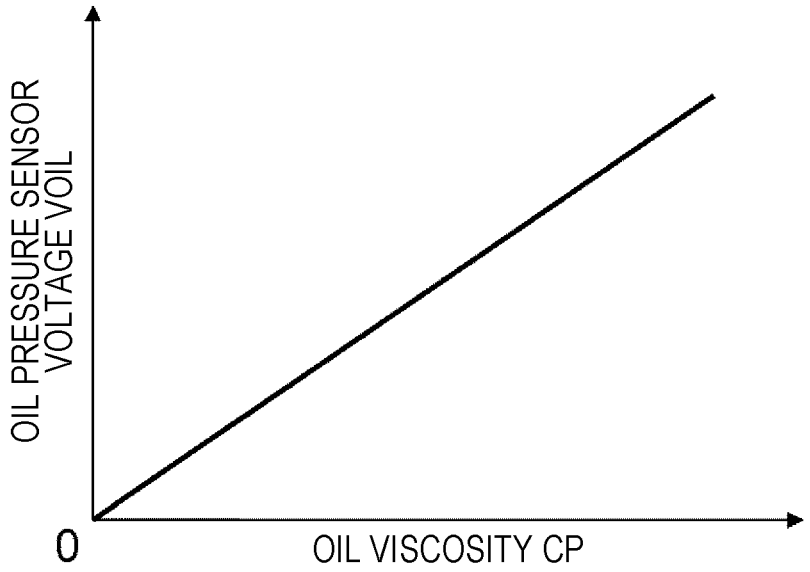
FIG. 9 describes characteristics of an oil pressure sensor and characteristics of an oil dilution ratio DR with respect to an oil viscosity CP, according to the embodiment of the present invention.
Figure 9:
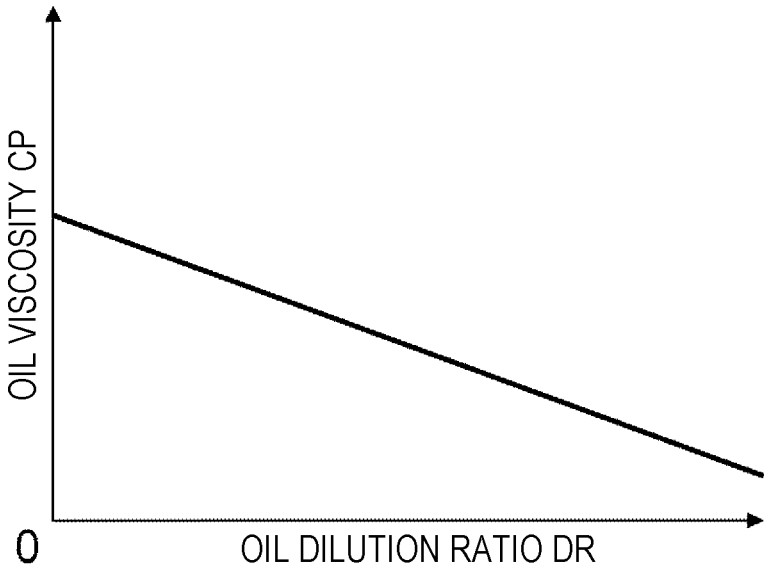
Figure 10:
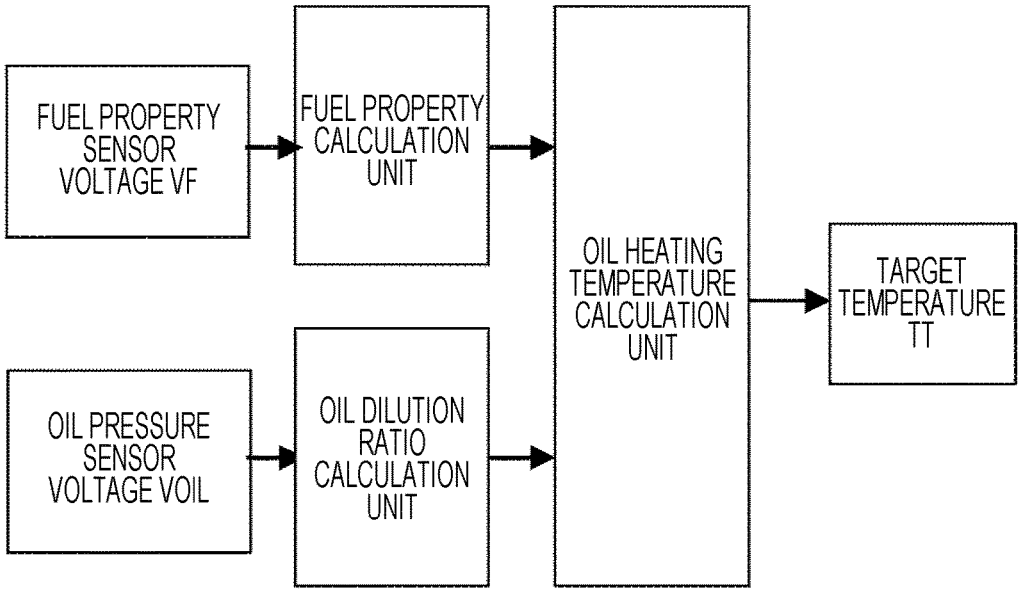
FIG. 10 is a logic diagram illustrating calculation logic of an oil heating temperature according to the embodiment of the present invention.

FIG. 9 illustrates characteristics of the oil pressure sensor 24 and characteristics of the oil dilution ratio DR with respect to the oil viscosity CP, according to the embodiment of the present invention. A vertical axis of the upper diagram indicates an oil pressure sensor voltage VOIL, and a horizontal axis indicates the oil viscosity CP. When the oil viscosity CP increases, the oil pressure sensor voltage VOIL increases. A vertical axis of the lower diagram indicates the oil viscosity CP, and a horizontal axis indicates the oil dilution ratio DR. When the oil dilution ratio DR increases, the oil viscosity CP decreases. This is because, fuel is diluted by oil, a ratio of the low-viscosity fuel increases, and consequently the viscosity of overall oil is decreased. Further, in the present invention, the oil dilution ratio DR is calculated by using the oil viscosity CP and the oil pressure sensor VOIL, but it is not limited thereto, and the mass of fuel diluted in oil, oil compositions, an oxygen concentration in a crank case, and a fuel injection amount integrated from engine start may be used, FIG. 10 is a logic diagram illustrating calculation logic of an oil heating temperature according to the embodiment of the present invention. The fuel property sensor voltage VF is input to the fuel property calculation unit, and based on the characteristic diagram in FIG. 8, any one or more of the fuel property T90, the 1/octane number NO, and the deterioration level LDE are calculated. The calculation result is input in the oil heating temperature calculation unit. The oil pressure sensor voltage VOIL is input to the oil dilution ratio calculation unit, and based on the characteristic diagram in FIG. 9, the oil dilution ratio DR is calculated. The calculation result is also input to the oil heating temperature calculation unit. The oil heating temperature calculation unit calculates a target temperature TT by using the calculation result. Preferably, when the oil dilution ratio is equal to or higher than a predetermined ratio (for example, a mass ratio is 6% or over), the oil heating temperature calculation unit calculates so as to increase the target temperature TT as the fuel property T90 increases.

Figure 11:
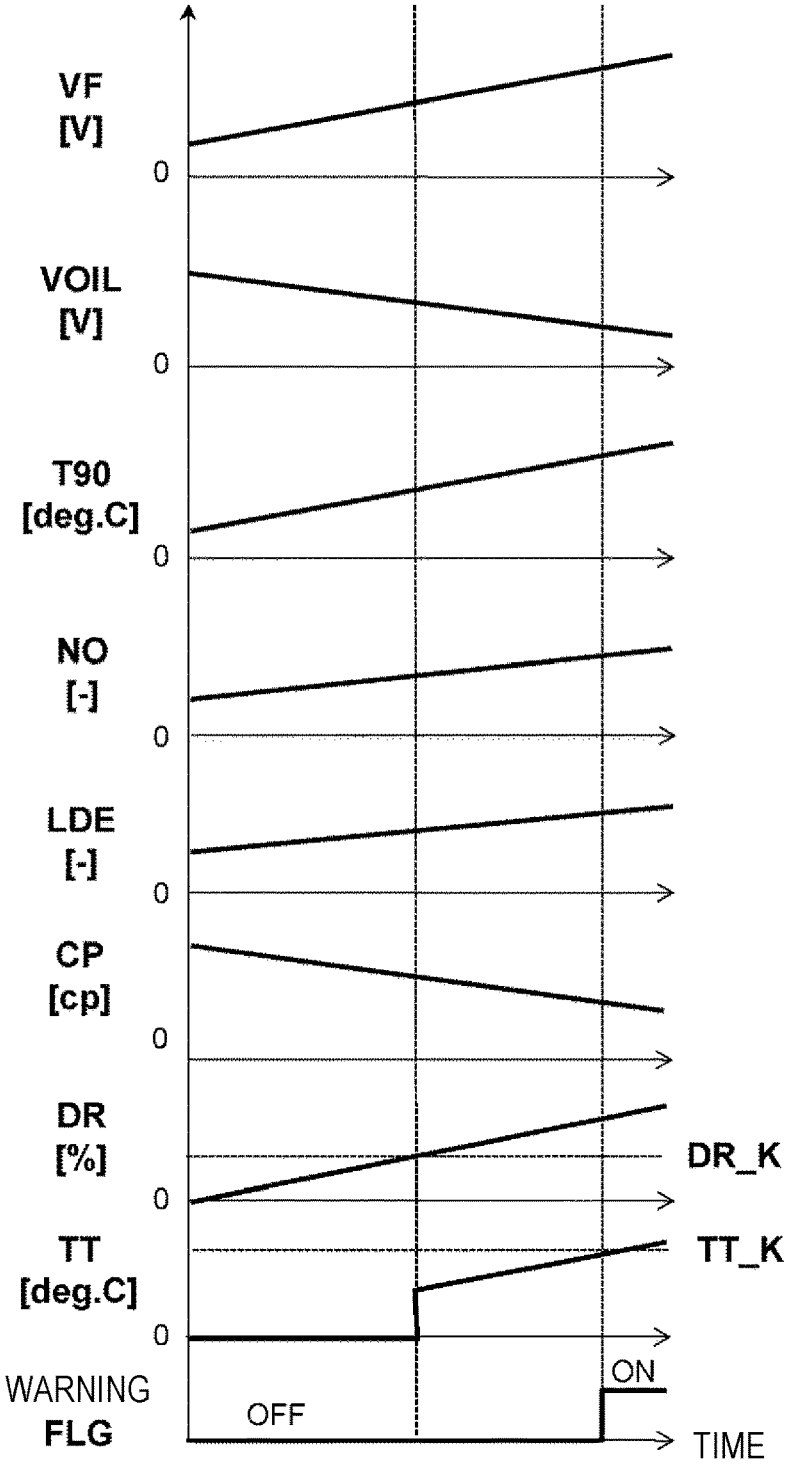
FIG. 11 illustrates characteristics of oil heating temperature calculation logic illustrating examples of calculation results of the oil heating temperature calculation logic according to the embodiment of the present invention.

FIG. 11 illustrates characteristics of oil heating temperature calculation logic illustrating examples of calculation results of the oil heating temperature calculation logic according to the embodiment of the present invention. Here, an input indicates that the fuel property sensor voltage VF increases with the lapse of time, and the oil pressure sensor voltage decreases with the lapse of time. As the fuel property sensor voltage VF increases, the fuel property T90 increases in the fuel property calculation unit. As a result, the fuel property the 1/octane number NO increases, and the fuel property deterioration level LDE also increases. With a decrease in the oil pressure sensor voltage VOIL, the oil viscosity CP decreases, and the oil dilution ratio DR increases.

Figure 12:
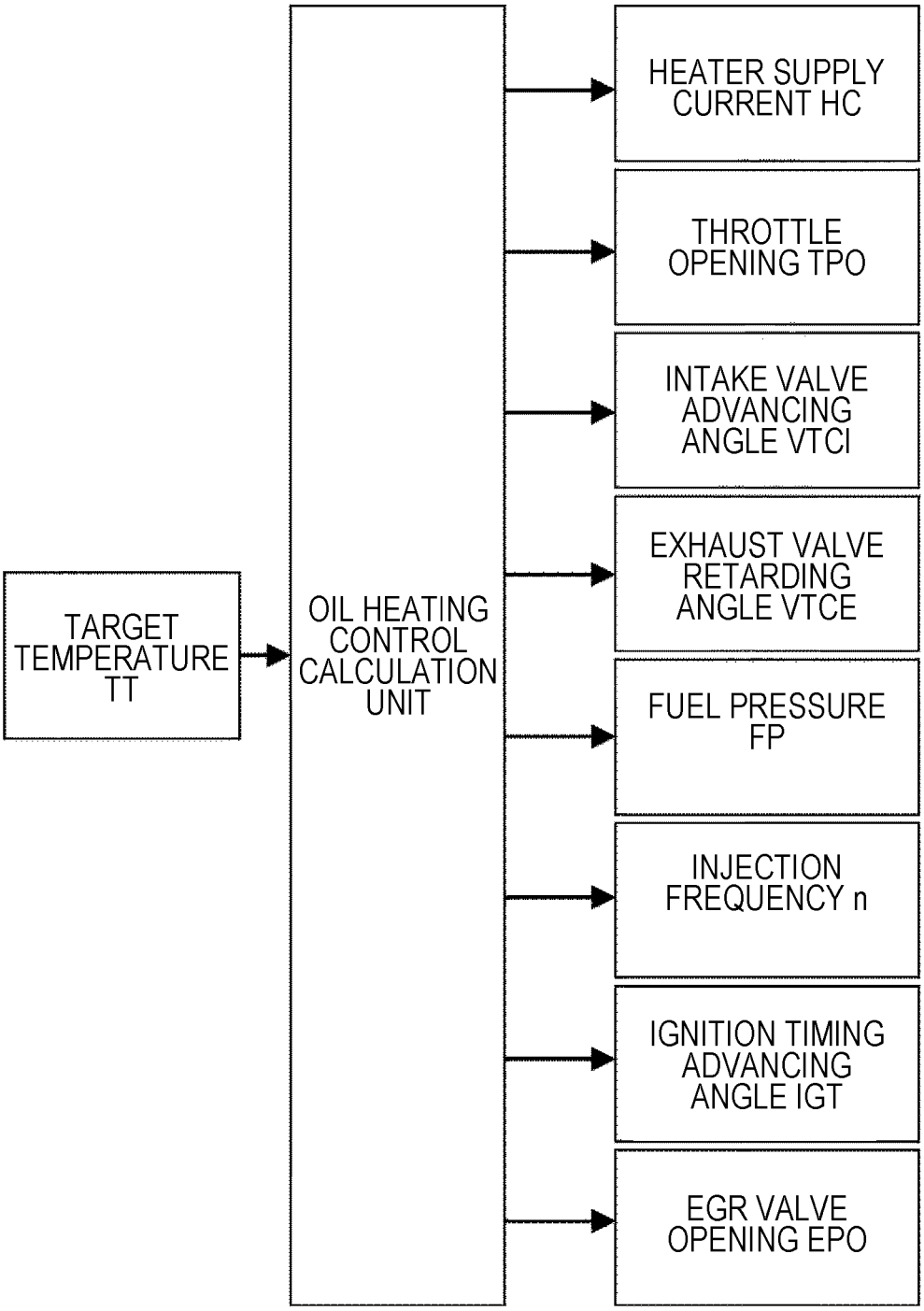
FIG. 12 is an oil heating control calculation logic diagram illustrating logic of an oil heating control calculation unit according to the embodiment of the present invention.

Here, in comparison with an oil dilution ratio limit value DR_K preliminary written in the engine control device according to the present invention, when the oil dilution ratio DR exceeds the oil dilution ratio limit value DR_K, the target temperature TT is output. The target temperature TT is output so as to increase as the fuel property T90 increases. In addition, in comparison with the target temperature limit value TT_K preliminary written in the engine control device according to the present invention, when the target temperature TT exceeds the target temperature limit value TT_K, a warning FLG is turned on. Preferably, the target temperature limit value TT_K is 130° C. or less. Further, here, it is exemplified that the fuel property sensor voltage VF increases with the lapse of time, and the oil pressure sensor voltage VOIL decreases with the lapse of time, but it is not limited thereto. The logic is applicable in the case where there are various input values such as that the fuel property sensor voltage VF is a constant value, and the oil pressure sensor voltage VOIL is a constant value FIG. 12 is an oil heating control calculation logic diagram illustrating logic of an oil heating control calculation unit according to the embodiment of the present invention. The target temperature TT is input in the oil heating control calculation unit. The oil heating calculation unit calculates the temperature in a combustion chamber TCOM, the heater supply current HC, and the engine startup time TO illustrated in FIGS. 6 and 7. Based on FIG. 6, the temperature in a combustion chamber TCOM is converted and calculated to the throttle opening TPO, the intake valve advancing angle VTCI, an exhaust valve retarding angle VTCE, the fuel pressure FP, the injection timing IT_SP, the injection frequency n, the ignition timing advancing angle IGT, the ignition frequency m, and the EGR valve opening EPO. The calculation result is output as the heater supply HC, the throttle opening TPO, the intake valve advancing angle VTCI, the exhaust valve retarding angle VTCE, the fuel pressure FP, the injection frequency n, the ignition timing advancing angle IGT, the ignition frequency m, and the EGR valve opening EPO. Here, each control calculation result is output, but is not limited thereto, and one or more of the calculation results may be calculated.

Figure 13:
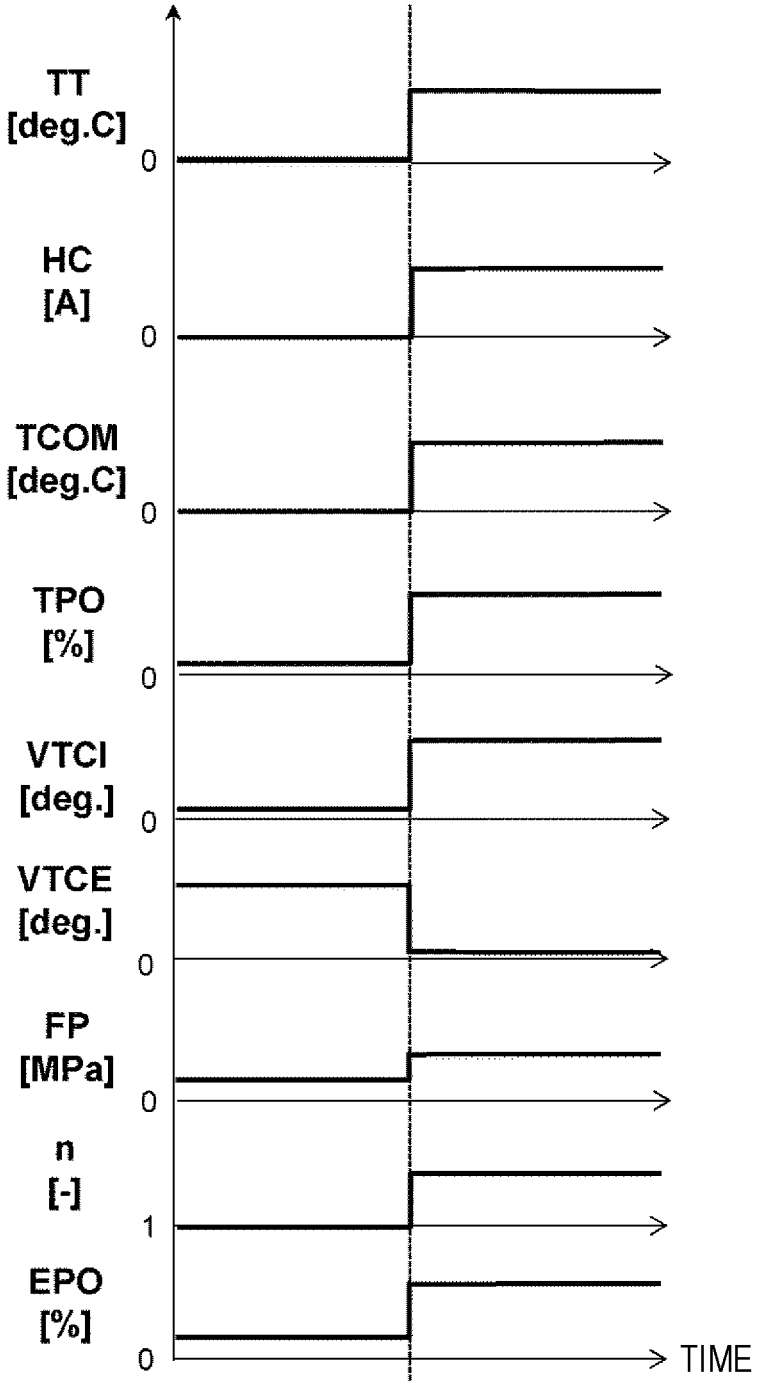
FIG. 13 is a characteristic diagram of an oil heating control calculation unit illustrating examples of calculation results by the oil heating control calculation unit according to the embodiment of the present invention.

FIG. 13 is a characteristic diagram of an oil heating control calculation unit illustrating examples of calculation results by the oil heating control calculation unit according to the embodiment of the present invention. Herein, a calculation result is indicated in the case where the target temperature TT is output based on the oil dilution ratio DR, the oil dilution ratio limit value DR_K, and the fuel property T90. The target temperature TT is calculated based on the oil dilution ratio DR, the oil dilution ratio limit value DR_K, and the fuel property T90. At this time, the heater supply current HC is output, and after the temperature in a combustion chamber TCOM is calculated, the throttle opening TPO, the intake valve advancing angle VTCI, the exhaust valve retarding angle VTCE, the fuel pressure FP, the injection frequency n, and the EGR valve opening EPO are output. The oil heating control calculation unit performs the above operations.

Figure 14:
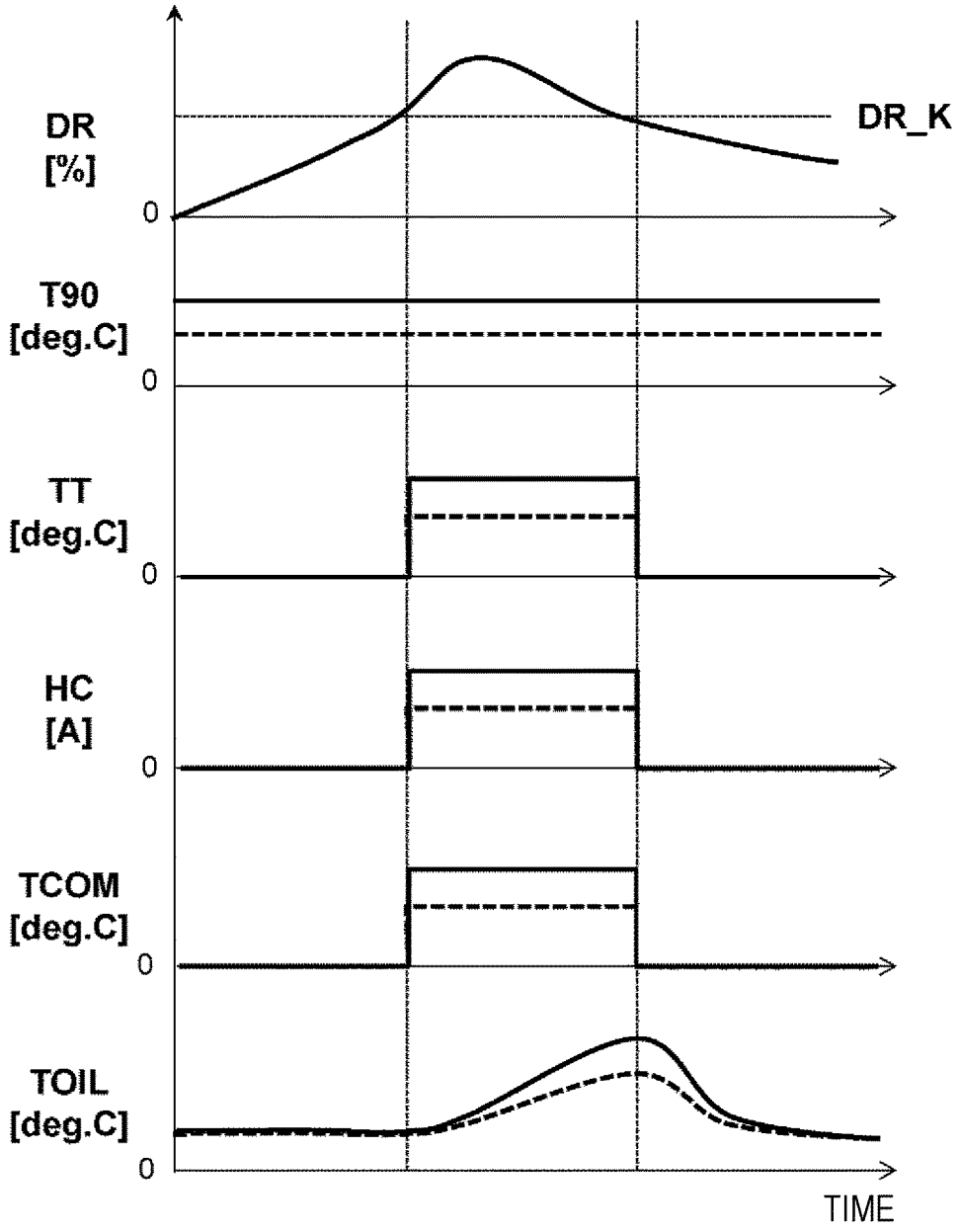
FIG. 14 describes a result of control to increase an oil temperature according to the embodiment of the present invention.

FIG. 14 exemplifies a result of control in which an oil temperature is increased according to the embodiment of the present invention. When the oil dilution ratio DR exceeds the oil dilution ratio limit value DR_K, the target temperature TT is output based on the fuel property T90, and the heater supply current HC and the temperature in a combustion chamber TCOM are increased. At this time, as the oil temperature TOIL increases, the oil dilution ratio DR decreases. This is because fuel diluted in oil vaporizes when the oil temperature increases. Further, when the oil dilution ratio DR is equal to or less than the oil dilution ratio limit DR_K, a calculation of the target temperature TT is stopped, and calculations of the heater supply current HC and the temperature in a combustion TCOM is stopped. Accordingly, the oil temperature TOIL decreases. As a result of the above-described operations, the oil dilution ratio DR is controlled in the present invention. In addition, the fuel property T90 indicated by a dotted line is lower than the fuel property T90 indicated by a solid line. In the case where the fuel property T90 is lower than the fuel property T90 indicated by the solid line like the fuel property T90 indicated by the dotted line, the target temperature TT, the heater supply current HC, and the temperature in a combustion chamber TCOM are set low. Consequently, the oil temperature TOIL is controlled to a low temperature. This is because, in the case where fuel in which the fuel property T90 is low is used, the fuel can be vaporized even if the oil temperature TOIL is set low. According to the heating control in response to the fuel property T90, both of a decrease in the oil dilution ratio DR and a minimization of energy consumption such as the heater supply current HC can be achieved.

Figure 15:
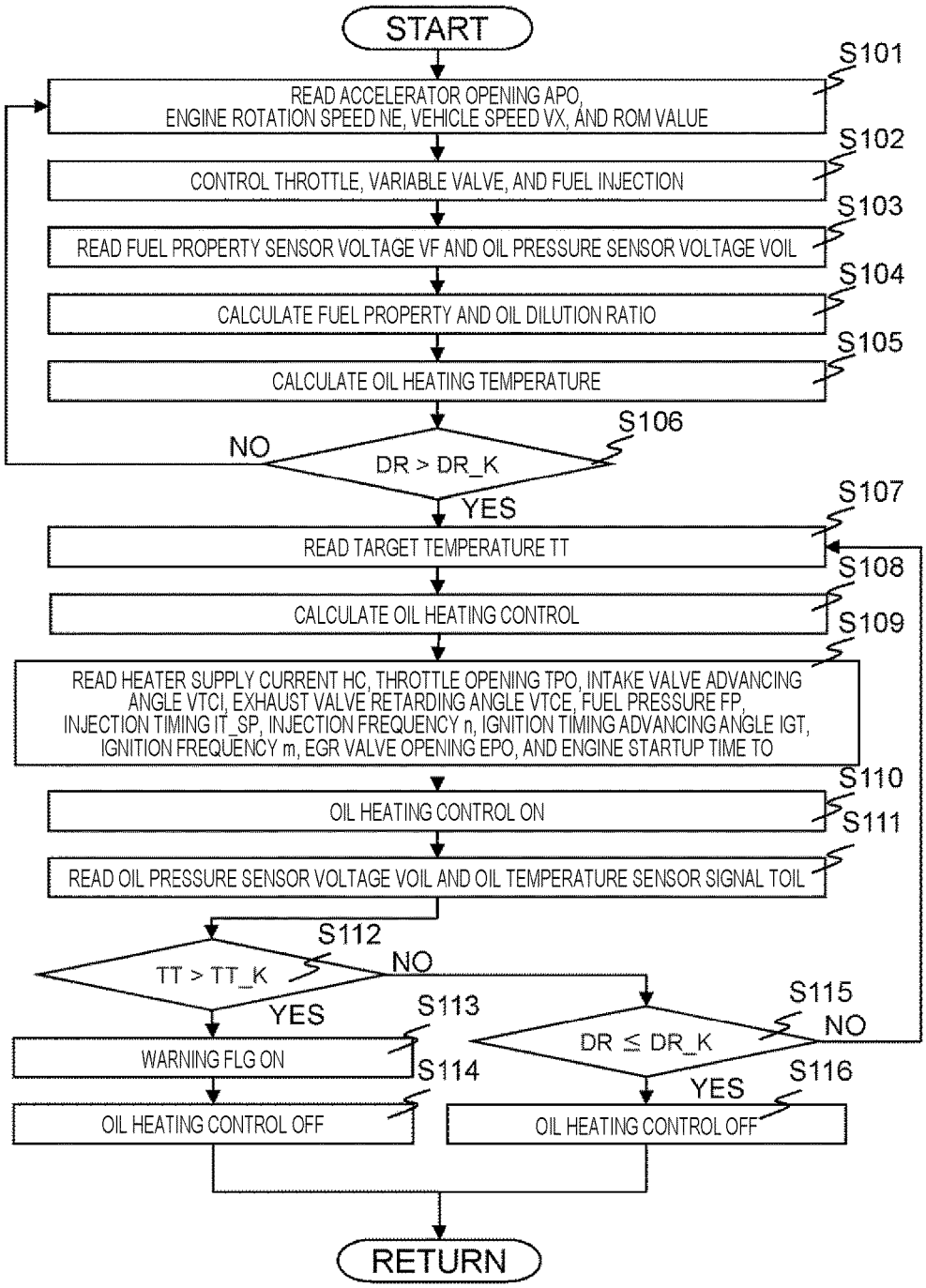
FIG. 15 is a flowchart illustrating control contents by the ECU 1 according to the embodiment of the present invention.

FIG. 15 is a flowchart illustrating control contents by the ECU 1 according to the embodiment of the present invention. The control contents indicated in FIG. 15 are repeated in a predetermine cycle by the ECU 1. In step S101, an accelerator opening APO, an engine rotation speed NE, a vehicle speed VX, and a value written in ROM in the ECU 1 are read in the ECU1. A request torque with respect to the engine 100 is calculated based on an output signal of the accelerator opening sensor 2. Next, in step S102, the throttle 5, the variable valve 10, and the injector 6 are controlled based on a result of step S101 to realize an appropriate intake air amount QA. Next, in step S103, the ECU 1 reads the fuel property sensor voltage VF and the oil pressure sensor voltage VOIL.

Next, in step S104, the ECU1 calculates a fuel property and an oil dilution ratio. Next, in step S105, the ECU1 calculates an oil heating temperature. Next, in step S106, it is determined whether the oil dilution ratio DR is larger than the oil dilution ratio limit value DR_K. If the ratio is larger, the ECU 1 performs step 107. If not, the ECU 1 returns to step S101. Next, in step S107, the target temperature TT is read.

Next, in step S108, the oil heating control is calculated. Next, in step S109, the ECU 1 reads the heater supply current HC, the throttle opening TPO, the intake valve advancing angle VTCI, the exhaust valve retarding angle VTCE, the fuel pressure FP, the injection start timing IT_SP, the injection frequency n, the ignition timing advancing angle IGT, the ignition frequency m, the EGR valve opening EPO, and the engine startup time TO. Next, in step S110, oil heating control starts and control each device based on the command value read in step S109.

Next, in step S111, the oil pressure sensor voltage VOIL and the oil temperature sensor voltage TOIL are read.

Next, in step S112, it is determined whether the target temperature TT is larger than the target temperature limit value TT_K. If the target temperature TT is larger, step S113 is performed, and if not, step S115 is performed. In step S113, the warning FLG is turned on.

Next, in step S114, the oil heating control is stopped. Next, in step S115, it is determined whether the oil dilution ratio DR is equal to or lower than the oil dilution ratio limit value DR_K. If the ratio is equal to or lower than the limit value, step S116 is performed. If not, step S107 is performed, and the oil heating control is repeated. In step S116, the oil heating control is stopped. The ECU 1 repeats the above-described flow in a predetermined cycle.

As described above, according to the present invention, in the case where fuel does not have a single boiling point, or in the case where vaporization characteristics of the fuel is changed, a target temperature of engine oil can be set based on the detected fuel property. As a result, excessive heating or sufficient heating of oil can be suppressed, and it contributes to achieve both of fuel combustion and regeneration of lubrication performance.

Next, a second embodiment according the present invention will be described with reference to FIGS. 16, 17, 18, 19, 20, 21, and 22.

Figure 16:
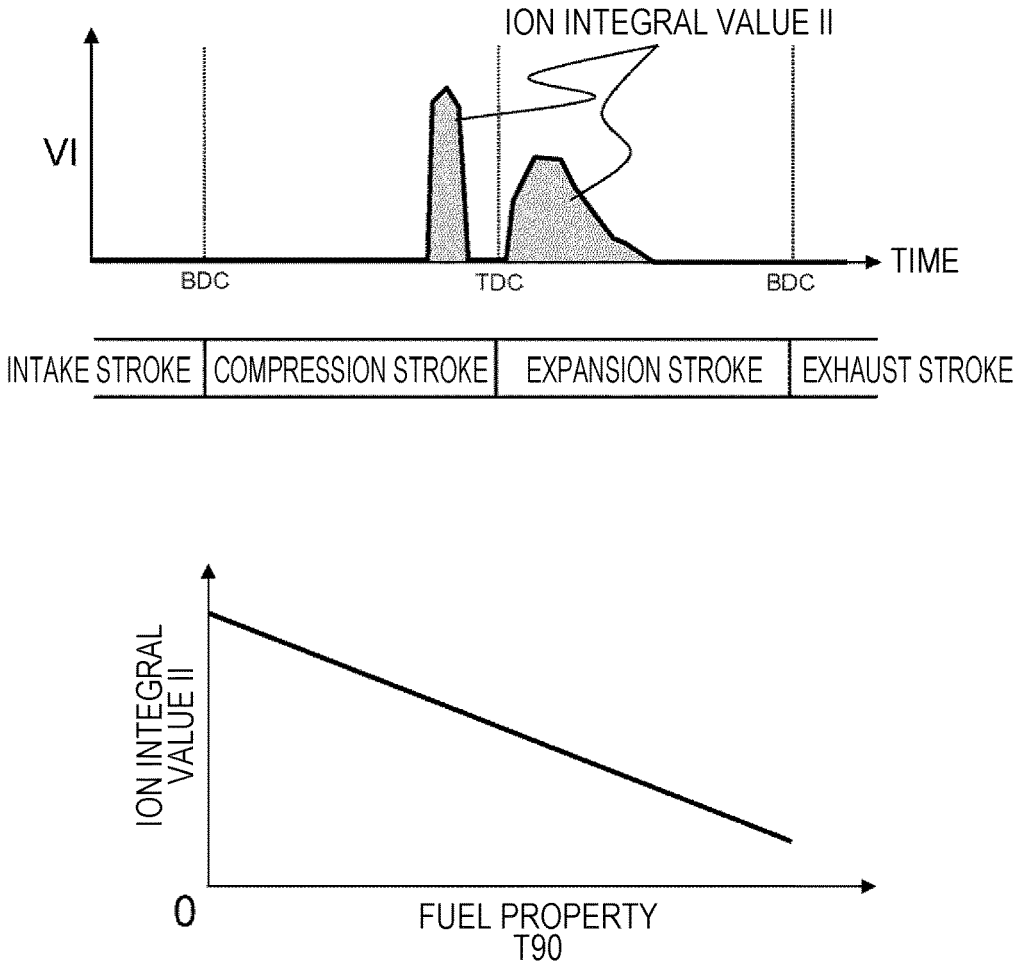
FIG. 16 describes characteristics of an ion sensor and characteristics of a fuel property T90 with respect to an ion integral value, according to a second embodiment of the present invention.

FIG. 16 illustrates characteristics of an ion sensor 23 and characteristics of a fuel property T90 with respect to an ion integral value, according to a second embodiment of the present invention. A vertical axis of the upper diagram indicates an ion sensor voltage VI, and a horizontal axis indicates a time. The ion sensor voltage VI outputs an amplitude signal as illustrated in the diagram between a compression stroke and an expansion stroke. An output described herein is an example and is changed in response to an operation state of the engine 100. The ECU 1 calculates an ion integral value II. A vertical axis of the lower diagram indicates the ion integral value II, and a horizontal axis indicates the fuel property T90. As the fuel property T90 increases, the ion integral value II decreases. This is because the fuel property T90 increases, the 1/octane number increases, an ignition timing retarding angle to avoid knocking is performed, an ion amount in the combustion chamber 14 decreases, and as a result, the ion integral value II decreases.

Figure 17:
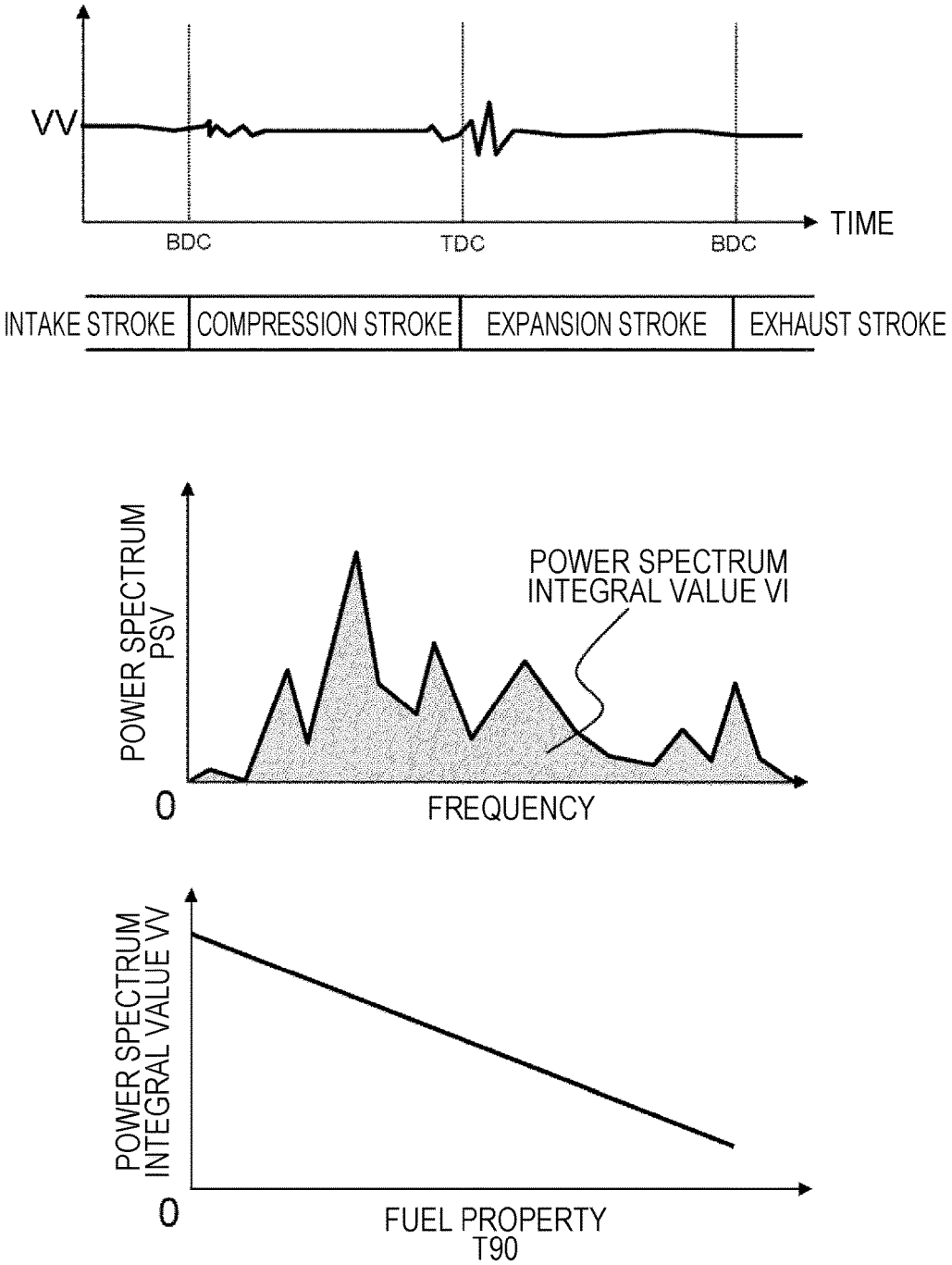
FIG. 17 describes characteristics of an accelerator sensor and signal processing of an accelerator sensor voltage, according to the second embodiment of the present invention.

FIG, 17 illustrates characteristics of the accelerator sensor 21 and an example of signal processing of an accelerator sensor voltage, according to the second embodiment of the present invention. A vertical axis of the upper diagram indicates an accelerator sensor voltage VV, and a horizontal axis indicates a time. The accelerator sensor voltage VV outputs an amplitude signal as illustrated in FIG. 17 between a compression stroke and an expansion stroke. An output described herein is an example and is changed in response to an operation state of the engine 100. Here, an operation example in which a frequency analysis of the accelerator sensor voltage VV is performed between the compression stroke and the expansion stroke is illustrated in the middle diagram. A vertical axis of the middle diagram indicates a power spectrum PSV, and a horizontal axis indicates a frequency. By performing a frequency analysis of the accelerator sensor signal, a signal intensity in each frequency, specifically the power spectrum PSV, can be calculated. Further, the power spectrum PSV is integrated by an arbitral frequency and defined as the power spectrum integral value VI. A vertical axis of the lower diagram indicates the power spectrum integral value VI, and a horizontal axis indicates the fuel property T90. As the fuel property T90 increases, the power spectrum integral value VI decreases. This is because the fuel property T90 increases, the 1/octane number increases, an ignition timing retarding angle to avoid knocking is performed, a vibration of the engine 100 decreases, and as a result, the power spectrum integral value VT decreases.

Figure 18:
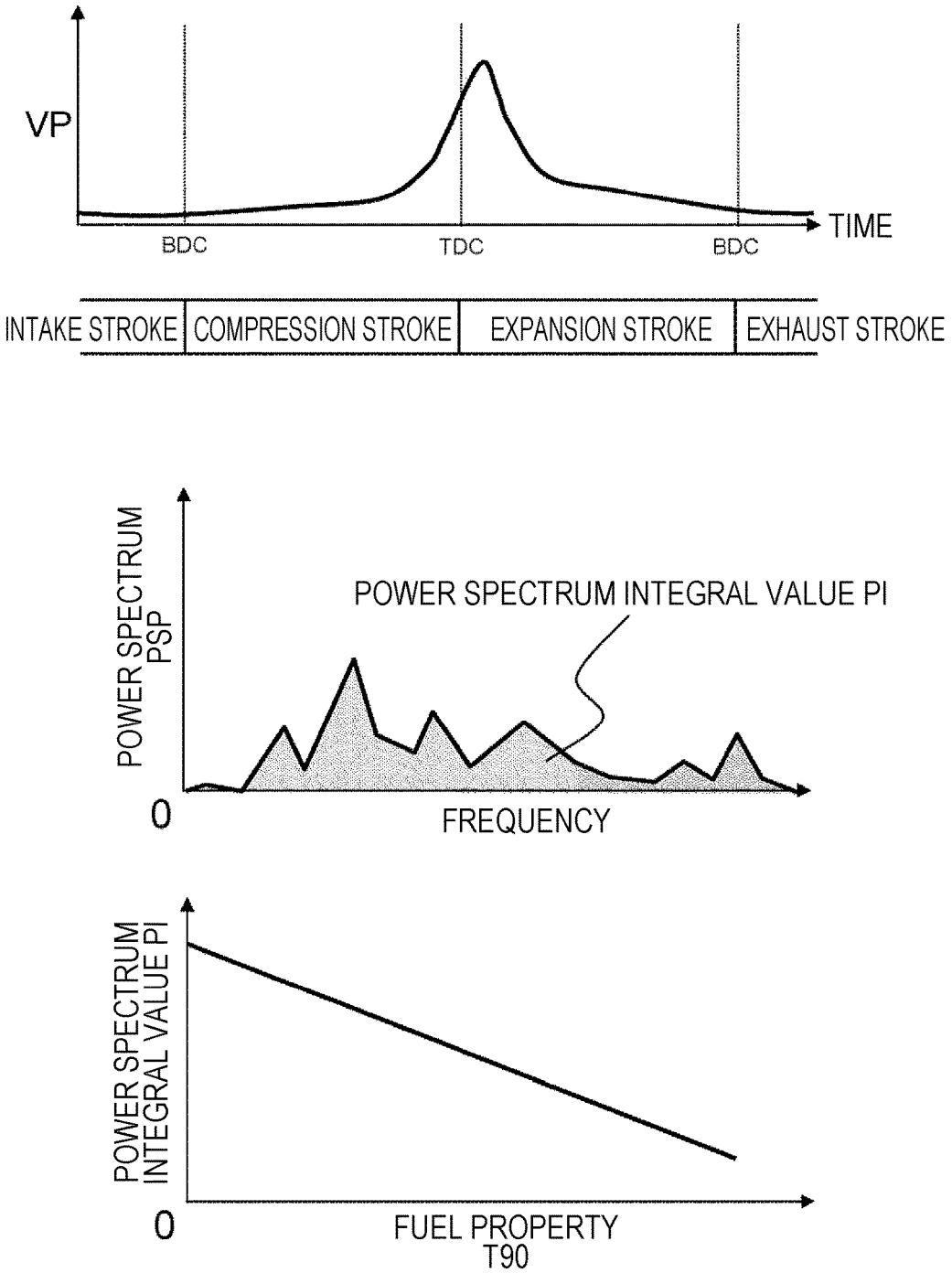
FIG. 18 describes characteristics of a pressure sensor and a signal processing result of a pressure sensor voltage, according to the second embodiment of the present invention.

FIG. 18 Illustrates characteristics of a pressure sensor and an example of a signal processing result of a pressure sensor voltage, according to the second embodiment of the present invention. The pressure sensor is included in the combustion chamber 14. A vertical axis of the upper diagram indicates a pressure sensor voltage VP, and a horizontal axis indicates a time. The pressure sensor voltage VP outputs an amplitude signal as illustrated in FIG. 18 between a compression stroke and an expansion stroke. An output described herein is an example and is changed in response to an operation state of the engine 100. Here, an operation example in which a frequency analysis of the pressure sensor voltage VP is performed between the compression stroke and the expansion stroke is illustrated in the middle diagram. A vertical axis of the middle diagram indicates a power spectrum PSP, and a horizontal axis indicates a frequency. By performing a frequency analysis of the pressure sensor signal, a signal intensity in each frequency, specifically the power spectrum PSP, can be calculated. Further, the power spectrum PSP is integrated by an arbitrary frequency and defined as a power spectrum integral value PI. A vertical axis of the lower diagram indicates the power spectrum integral value PI, and a horizontal axis indicates the fuel property T90. As the fuel property T90 increases, the power spectrum integral value PI decreases. This is because the fuel property T90 increases, the 1/octane number increases, an ignition timing retarding angle to avoid knocking is performed, a pressure of the combustion chamber 14 decreases, and as a result, the power spectrum integral value PI decreases.

Figure 19:
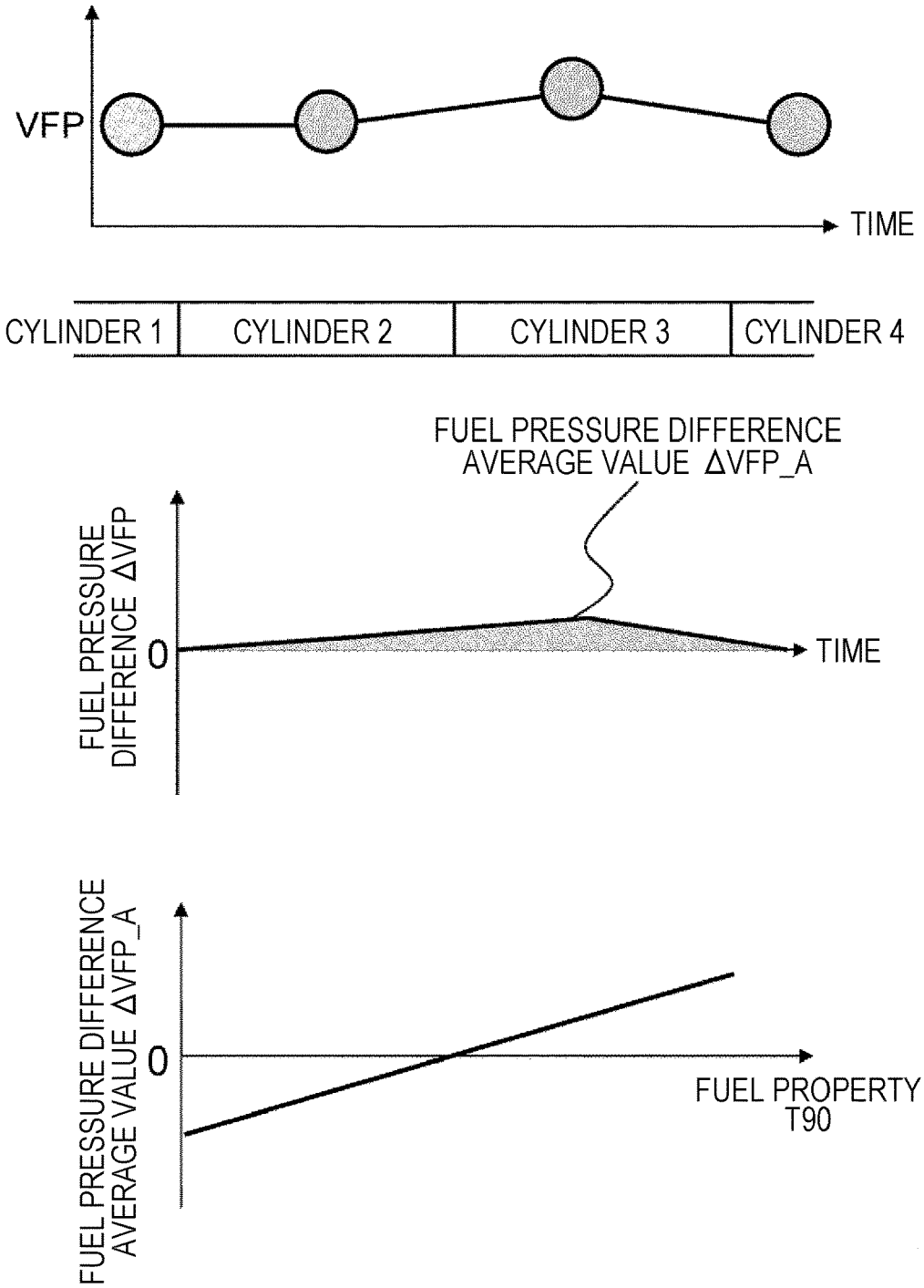
FIG. 19 describes a signal processing result of a fuel pressure sensor voltage according to the second embodiment of the present invention.

FIG. 19 illustrates characteristics as an example of a signal processing result of a fuel pressure sensor voltage according to the second embodiment of the present invention. The fuel pressure sensor is included in the common rail 8. A vertical axis of the upper diagram indicates a fuel pressure sensor voltage VFP, and a horizontal axis indicates a time. The pressure sensor voltage VFP outputs a voltage signal as illustrated in FIG. 19 in each cylinder. An output described herein is an example and is changed in response to an operation state of the engine 100. A difference between the fuel pressure sensor voltage VFP and a targeted fuel pressure is denoted by ΔVFP and indicated in the middle diagram. A vertical axis indicates the fuel pressure difference ΔVFP, and a horizontal axis indicates a time. The fuel pressure difference ΔVFP indicates a value which increases and decreases in a zero-cycle. Here, an average time of the fuel pressure difference ΔVFP is defined as a fuel pressure difference average value ΔVFP_A. A vertical axis of the lower diagram indicates the fuel pressure difference average value ΔVFP_A, and a horizontal axis indicates the fuel property T90. As the fuel property T90 increases, the fuel difference average value ΔVFP_A increases. This is because as the fuel property T90 increases, light components are vaporized, and accordingly, as a result of increasing a viscosity of fuel, a fuel pressure increases with respect to a target fuel pressure.

Figure 20:
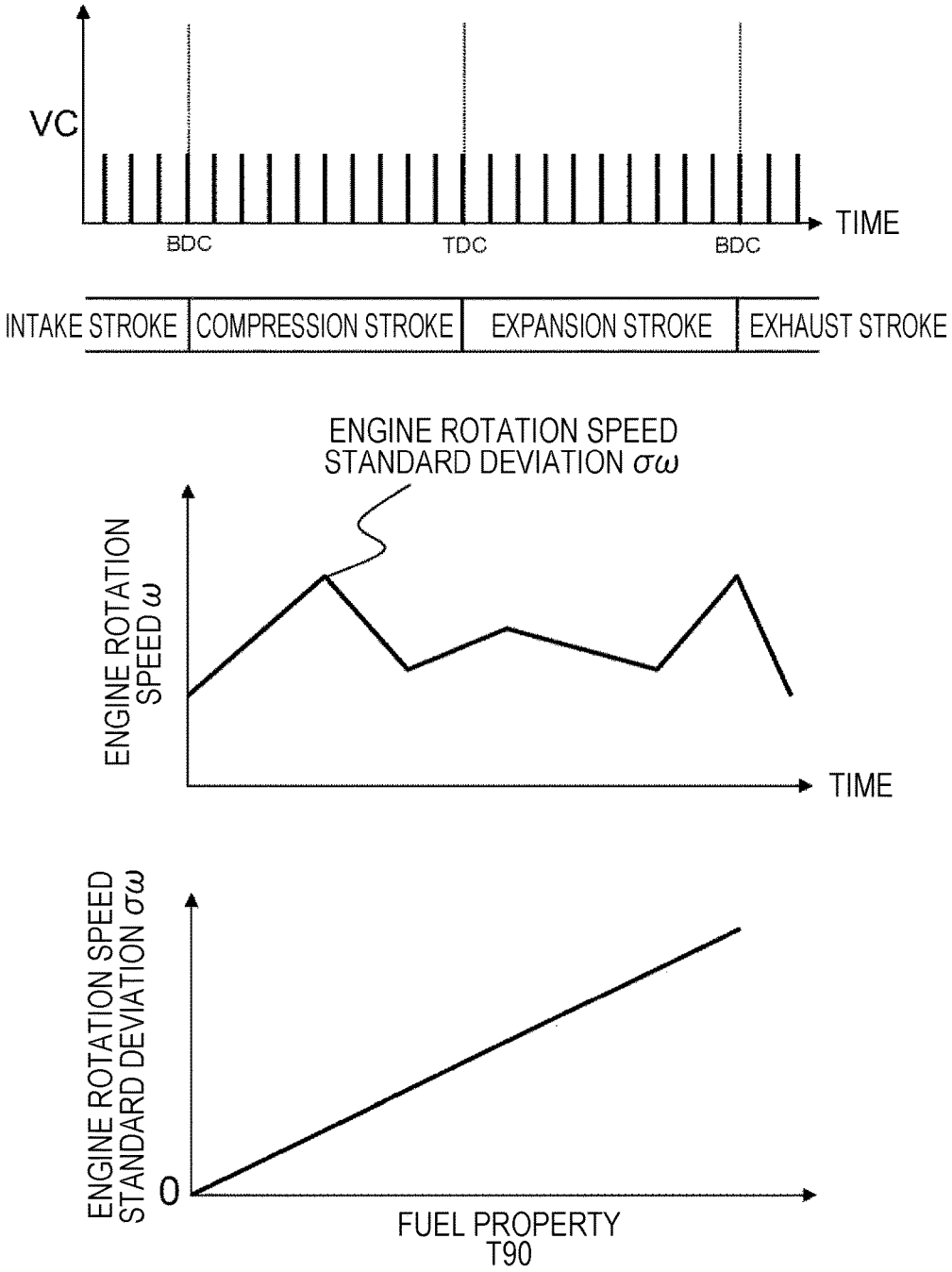
FIG. 20 describes a signal processing result of a crank angle sensor voltage according to the second embodiment of the present invention.

FIG. 20 illustrates characteristics as an example of a signal processing result of a crank angle sensor voltage according to the second embodiment of the present invention. Here, the crank angle sensor 13 is provided at a position close to the crank shaft 12. A vertical axis of the upper diagram indicates a crank angle sensor voltage VC, and a horizontal axis indicates a time. The crank angle sensor voltage VC outputs pulse signals as illustrated in FIG. 20 in an intake stroke, a compression stroke, an expansion stroke, and an exhaust stroke. An output indicated herein is an example and is changed in accordance with a structure of a gear fastened to the crank shaft 12. Here, when an engine rotation speed ω is calculated by using the crank angle sensor voltage VC and a time, a result illustrated in the middle diagram is obtained. A vertical axis indicates the engine rotation speed ω, and a horizontal axis indicates a time. The engine rotation speed ω is sequentially changed as illustrated in the FIG. 20. Here, a standard deviation of the engine rotation speed ω is calculated by defining as the engine rotation speed standard change σω. The engine rotation speed standard deviation σω indicates a change in an engine rotation speed. Here, a standard deviation is calculated in the present invention, but is not limited thereto, and each type of deviation and an average value may be used. A vertical axis of the lower diagram indicates the engine rotation speed standard deviation σω, and a horizontal axis indicates the fuel, property T90. As the fuel property T90 increases, the engine rotation speed standard deviation σω increases. This is because heavy components are remained due to an increase in the fuel property T90, and accordingly fuel is not easily vaporized, and air-fuel mixture is not easily mixed. As a result, fluctuation of the engine rotation speed is easily increased.

Figure 21:
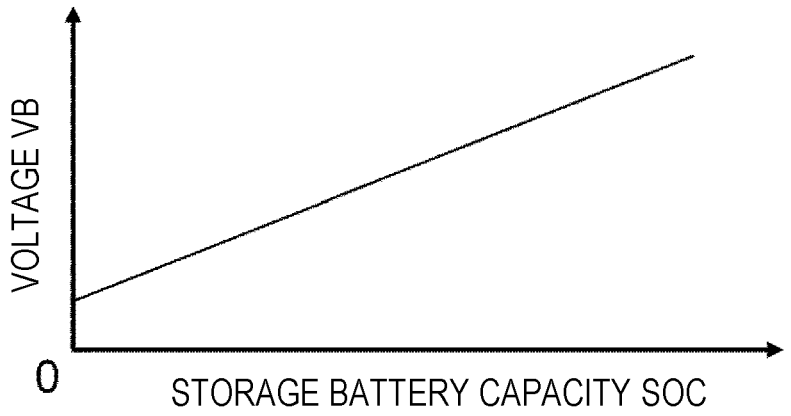
FIG. 21 describes a signal processing result of a voltage sensor according to the second embodiment of the present invention.

FIG. 21 illustrates characteristics as an example of a signal processing result of a voltage sensor according to the second embodiment of the present invention. Here, a voltage sensor is provided at an appropriate position of the wire 33. A vertical axis of the diagram indicates a voltage VB, and a horizontal axis indicates a storage battery capacity SOC. As the storage battery capacity SOC increases, the voltage VB increases. Here, the voltage VB with respect to the storage battery capacity SOC is indicated, but it is not limited thereto. A same relation with a parameter on electric charge energy remained in the storage battery 31 may be used.

Figure 22:
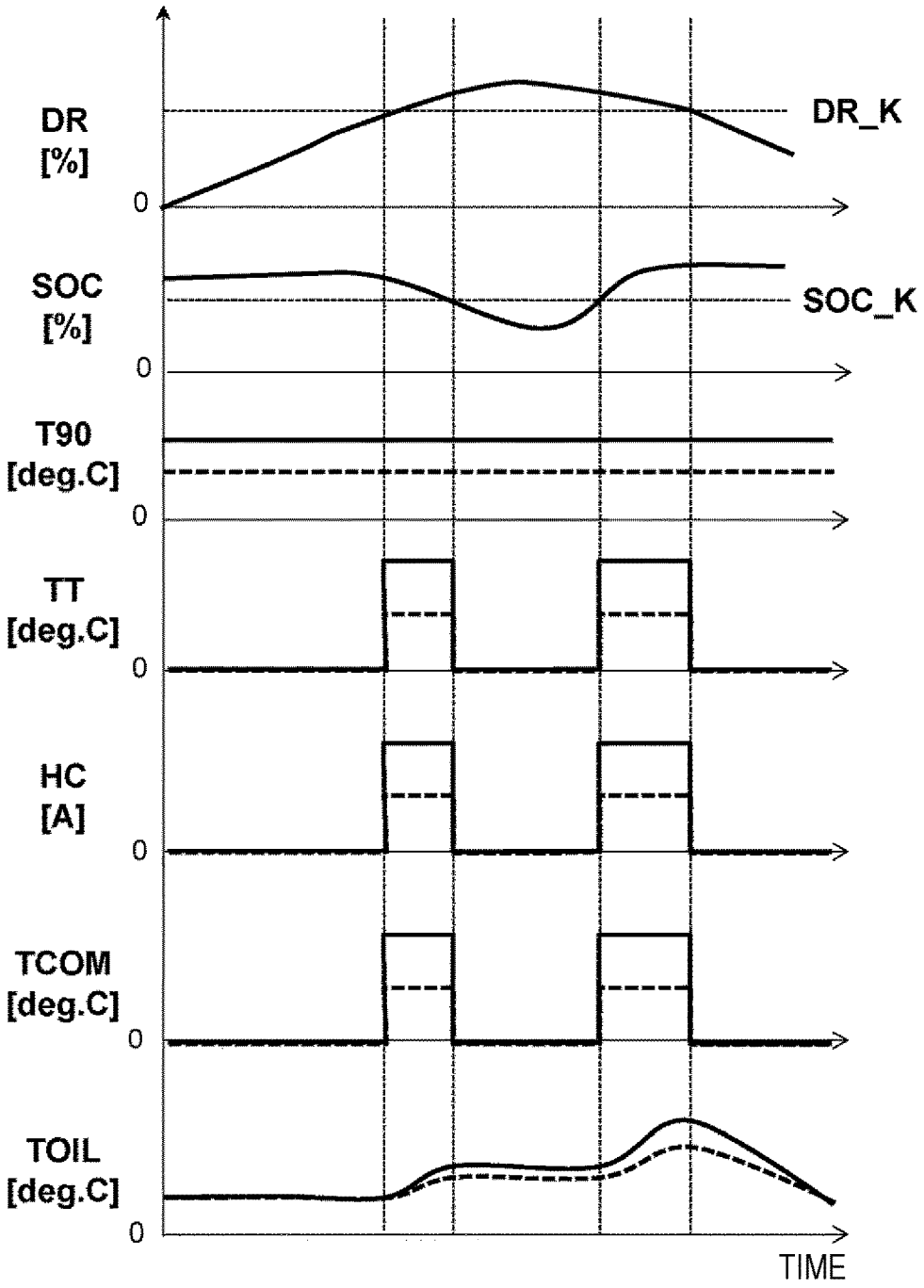
FIG. 22 describes a result of control to increase an oil temperature according to the second embodiment of the present invention.

FIG. 22 exemplifies a result of control in which an oil temperature is increased according to the second embodiment of the present invention. When the oil dilution ratio DR exceeds the oil dilution ratio limit value DR_K and when the storage battery capacity SOC is larger than the storage battery capacity limit value SOC_K which is an arbitrary value, the target temperature TT is output based on the fuel property T90, and the heater supply current HC and the temperature in a combustion chamber TCOM are increased. At this time, as the oil temperature TOIL increases, an increase tendency of the oil dilution ratio DR decreases. This is because fuel diluted in oil vaporizes when the oil temperature increases. Further, when the storage battery capacity SOC is less than the storage battery capacity limit value SOC_K, an output of the target temperature TT is stopped even when the oil dilution ratio DR is larger than the oil dilution ration limit value.

Next, when the storage battery capacity SOC is again larger than the storage battery capacity limit value SOC_K, the target temperature TT is output, and the heater supply current HC and the temperature in a combustion chamber TCOM are output based on the fuel property T90. Accordingly, after the oil temperature is once increased, the increase is stopped, and then the oil temperature is again increased. Specifically, when the oil dilution ratio DR is larger than the oil dilution ratio limit value DR_K and when the storage battery capacity SOC is larger than the storage battery capacity limit value, heating control is performed based on the fuel property T90. Further, the target temperature TT is changed based on the fuel property T90. Further, when the oil dilution ratio DR is equal to or less than the of dilution ratio limit DR_K, a calculation of the target temperature TT is stopped, and calculations of the heater supply current HC and the temperature in a combustion TCOM is stopped. Accordingly, the oil temperature TOIL decreases.

As a result of the above-described operations, the oil dilution ratio DR is controlled in the present invention. In addition, the fuel property T90 indicated by a dotted line is lower than the fuel property T90 indicated by a solid line. In the case where the fuel property T90 is lower than the fuel property T90 indicated by the solid line like the fuel property T90 indicated by the dotted line, the target temperature TT, the heater supply current HC, and the temperature in a combustion chamber TCOM are set low. Consequently, the oil temperature TOIL is controlled to a low temperature. This is because, in the case where fuel in which the fuel property T90 is low is used, the fuel can be vaporized even if the oil temperature TOIL is set low. According to the heating control in response to the fuel property T90, both of a decrease in the oil dilution ratio DR and a minimization of energy consumption such as the heater supply current HC can be achieved.

Figure 23:
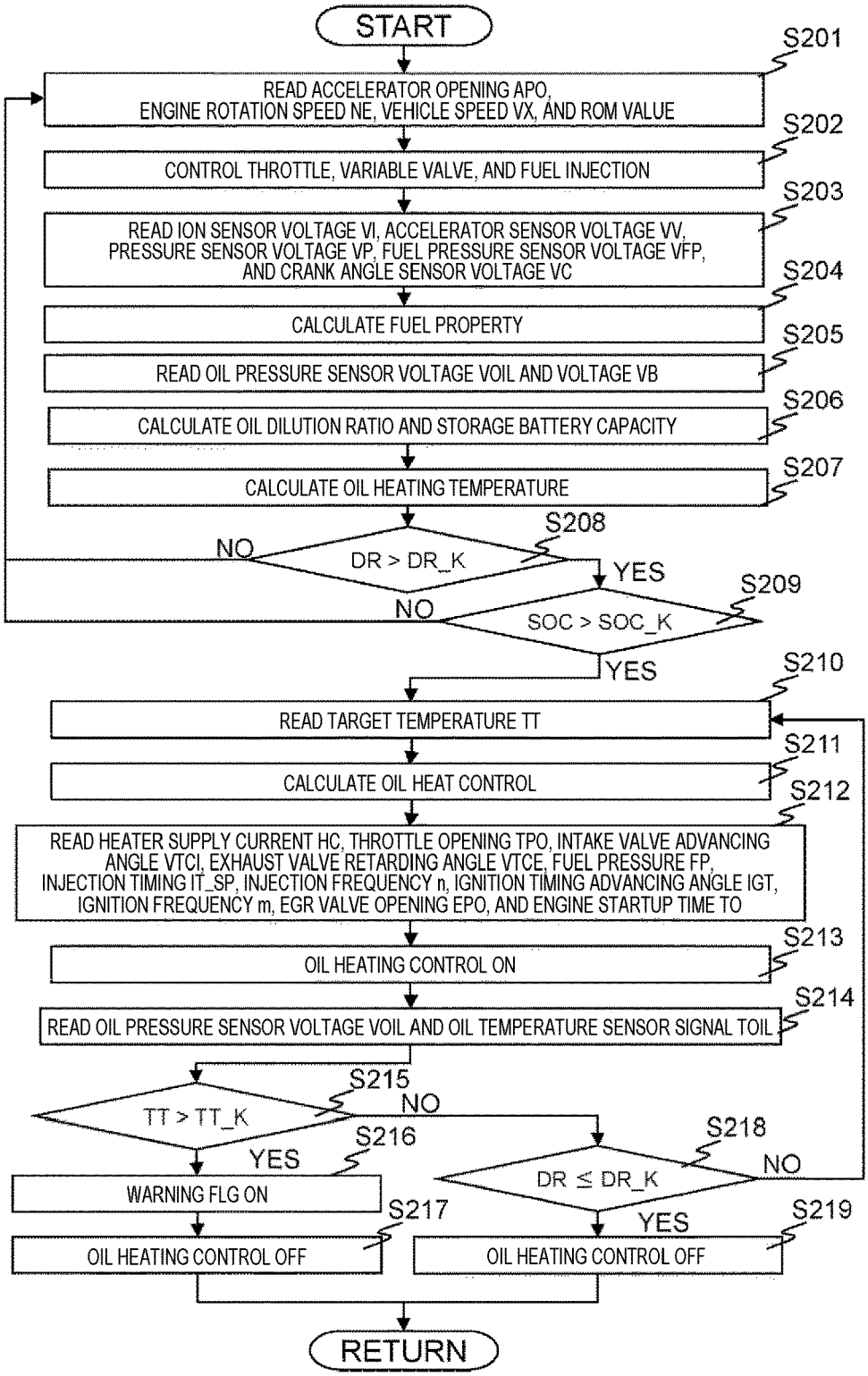
FIG. 23 is a flowchart illustrating control contents by the ECU 1 according to the second embodiment of the present invention.

FIG. 23 is a flowchart illustrating control contents by the ECU 1 according to the second embodiment of the present invention. The control contents indicated in FIG. 23 is repeated in a predetermine cycle by the ECU 1. In step S201, an accelerator opening APO, an engine rotation speed NE, a vehicle speed VX, and a value written in ROM in the ECU 1 are read in the ECU1. A request torque with respect to the engine 100 is calculated based on an output signal of the accelerator opening sensor 2.

Next, in step S202, the throttle 5, the variable valve 10, and the injector 6 are controlled based on a result of step S201 to realize appropriate intake air amount QA. Next, in step S203, the ECU 1 reads the ion sensor voltage VI, the accelerator sensor voltage VV, the pressure sensor voltage VP, the fuel pressure sensor voltage VFP, and the crank angle sensor voltage VC. Next, in step S205, the ECU 1 calculates fuel properties.

Next, in step S205, the ECU 1 reads the fuel pressure sensor voltage VOIL and the voltage VB. Next, in step S206, an oil dilution ratio and a storage battery capacity are calculated. Next, in step S207, an oil heating temperature is calculated.

Next, in step S208, it is determined whether the oil dilution ratio DR is larger than the oil dilution ratio limit value DR_K. If the ratio is larger, step S209 is performed. If not, step S201 is performed.

Next, in step S209, it is determined whether the storage battery capacity SOC is larger than the storage battery limit value SOC_K. If the capacity is larger, step S210 is performed, and if not, step S201 is performed. Next, in step S210, the target temperature TT is read.

Next, in step S211, an oil heating control value is calculated. Next, in step S212, the ECU 1 reads the heater supply current HC, the throttle opening TPO, the intake valve advancing angle VTCI, the exhaust valve retarding angle VTCE, the fuel pressure FP, the injection timing IT_SP, the injection frequency n, the ignition timing advancing angle IGT, the ignition frequency m, the EGR valve opening EPO, and the engine startup time TO.

Next, in step S213, oil heating control starts and control each device based on the command value read in step S212.

Next, in step S214, the oil pressure sensor voltage VOIL and the oil temperature voltage TOIL are read. Next, in step S215, it is determined whether the target temperature TT is larger than the target temperature limit value TT_K. If the target temperature TT is larger, step S216 is performed, and if not, step S218 is performed. In step S216, the warning FLG is turned on.

Next, in step S217, the oil heating control is stopped. Next, in step S218, it is determined whether the oil dilution ratio DR is equal to or lower than the oil dilution ratio limit value DR_K. If the ratio is equal to or lower than the limit value, step S219 is performed. If not, step S210 is performed, and the oil heating control is repeated. In step S219, oil heating control is stopped. The ECU 1 repeats the above-described flow in a predetermined cycle.

According to the present embodiment, fuel properties are detected by using a unit other than the fuel property sensor, and based on the detected fuel properties, a target temperature of engine oil can be appropriately set. As a result, a system configuration in which the fuel property sensor is not provided can suppress excessive heating or sufficient heating of oil and contribute to achieve both of fuel combustion and regeneration of lubrication performance.

REFERENCE SIGNS LIST

1 ECU
2 accelerator opening sensor
3 air flow sensor
4 intake air temperature sensor
5 throttle
6 injector
7 fuel pump
8 common rail
9 intake pipe
10 variable valve
11 piston
12 crank shaft
13 crank angle sensor
14 combustion chamber
15 cooling water temperature sensor
16 ignition plug
17 exhaust pipe
18 three-way catalyst
19 exhaust temperature sensor
20 air fuel ratio sensor
21 accelerator sensor
22 fuel property sensor
23 ion sensor (pressure sensor)
24 oil pressure sensor
25 oil temperature sensor
26 voltage sensor (current sensor)
27 heater
28 EGR valve
29 exhaust recirculation pipe
30 warning lamp
31 storage battery
32 fuel piping
33 wire
100 engine

The invention claimed is:

1. An control device comprising:

an engine control device configured to control a temperature of oil lubricating an interior of an engine, wherein the temperature of the oil is controlled so as to prevent excessive heating and insufficient heating based on a detection result of a property of fuel being supplied to the engine, and the engine control device is also configured to change the temperature of the oil to increase the temperature and decrease the temperature based on a change of the vaporization characteristics, an octane number, and a deterioration level of the fuel.

2. The control device according to claim 1, wherein any one or more of vaporization characteristics, an octane number, and a deterioration level of the fuel is detected as the fuel property.

3. The control device according to claim 2, wherein, in a detection unit for the fuel property, the fuel property is detected based on any one of a pressure in a fuel supply device, acceleration of an engine, ion amounts in the engine, a pressure in the engine, a crank rotation speed of the engine, and a fuel distillation temperature.

4. The control device according to claim 2, wherein a target temperature for heating the oil is increased when any one or more of deterioration of the vaporization characteristics, a decrease in the octane number, and an increase in the deterioration level are detected in the fuel.

5. The control device according to claim 4, wherein when a target temperature for heating the oil exceeds a predetermined temperature, the device stops heating the oil, and commands a signal indicating an abnormality of oil or a signal indicating an abnormality of fuel.

6. The control device according to claim 2, wherein any one or more of a heater current, an ignition timing, a throttle opening, an intake valve close timing, an exhaust valve close timing, an overlap period, an EGR valve opening, a fuel injection pressure, a fuel injection timing, divided injection frequencies, and an engine operation time are controlled to control the oil temperature.

7. The control device according to claim 2, wherein the oil temperature is controlled when a pressure of the oil lubricating the interior of the engine is equal to or lower than a predetermined pressure, or a viscosity of the oil is equal to or lower than a predetermined viscosity.

8. The control device according to claim 7, wherein the oil temperature control is performed when a charged state of an on-vehicle storage battery is larger than a predetermined value.

* * * * *